US008491506B2

(12) United States Patent
Smyrk et al.

(10) Patent No.: US 8,491,506 B2
(45) Date of Patent: Jul. 23, 2013

(54) EXERCISE DEVICE

(75) Inventors: Rodney William Smyrk, Sunbury (AU); Claude Mario Sfilgoj, Ballarat (AU)

(73) Assignee: Caraleen Enterprises Pty Ltd, Sunbury, Victoria (AU)

( * ) Notice: Subject to any disclaimer, the term of this patent is extended or adjusted under 35 U.S.C. 154(b) by 1132 days.

(21) Appl. No.: 11/814,541

(22) PCT Filed: Sep. 9, 2005

(86) PCT No.: PCT/AU2005/001379

§ 371 (c)(1), (2), (4) Date: Mar. 29, 2008

(87) PCT Pub. No.: WO2006/026831

PCT Pub. Date: Mar. 16, 2006

(65) Prior Publication Data

US 2009/0098984 A1 Apr. 16, 2009

(30) Foreign Application Priority Data

Sep. 9, 2004 (AU) ..... 2004905179
Sep. 9, 2005 (WO) ..... PCT/AU2005/001379

(51) Int. Cl.
*A61H 1/02* (2006.01)
*A63B 23/00* (2006.01)

(52) U.S. Cl.
USPC ..... 601/35; 601/24; 601/26; 482/72

(58) Field of Classification Search
USPC ..... 601/5, 23, 24, 26, 27, 33, 34, 35; 482/51, 482/72, 131, 142
See application file for complete search history.

(56) References Cited

U.S. PATENT DOCUMENTS 4,363,481 A * 12/1982 Erickson ..... 601/24
4,986,261 A * 1/1991 Iams et al. ..... 601/35
5,141,483 A * 8/1992 Smith ..... 482/142
5,258,019 A * 11/1993 Riddle et al. ..... 606/242
5,282,748 A * 2/1994 Little ..... 482/56
5,376,060 A * 12/1994 Murray ..... 482/56
6,821,231 B1 11/2004 Hall
6,821,288 B2 * 11/2004 Schaeffer ..... 606/240

OTHER PUBLICATIONS

PCT International Preliminary Report on Patentability (Chapter I) issued for PCT/AU2005/001379, dated Mar. 13, 2007.

* cited by examiner

*Primary Examiner* — Quang D Thanh
(74) *Attorney, Agent, or Firm* — Shaukat A. Karjeker; Colin P. Cahoon; Carstens & Cahoon, LLP

(57) ABSTRACT

The present invention provides an exercise device which includes at least one pair of independently movable leg supports which are pivotally connectable to a main body support to raise and lower, either separately and/or together, a user's legs during exercise between upper and lower positions and an adjustment device to allow the positions of said the upper and lower positions to be changed.

9 Claims, 26 Drawing Sheets

EXERCISE DEVICE

FIELD OF THE INVENTION

This invention relates, in general, to an exercise device and relates more particularly, though not exclusively, to an exercise device which can allow the user to perform multiple exercises on one and the same machine or piece of equipment.

BACKGROUND OF THE INVENTION

The present invention in aspect provides an exercise device which includes at least one pair of independently movable leg supports which are pivotally connectable to a main body support to raise and lower, either separately and/or together, a user's legs during exercise between upper and lower positions and an adjustment device to allow the positions of said upper and lower positions to be changed.

SUMMARY OF INVENTION

In a further aspect of the invention there is provided an exercise device which includes at least one pair of independently movable leg supports which are pivotally connectable to a main body support to raise and lower a user's legs, either separately and/or in unison, during exercise between upper and lower positions, a C-shaped support member having a pair of side arms and a vertical link arm whereby the side arms are pivotally mounted to provide a swivelling or swinging action for said vertical link arm, and wherein at least one pair of said leg supports are pivotally attached to opposing sides of said vertical link to allow a swivelling or swinging movement for said leg supports.

Preferably said exercise device further includes an adjustment device to allow the positions of said upper and lower positions to be changed. Preferably a seat is attached to the uppermost of said side arms.

In a further aspect of the invention there is provided an exercise device which includes at least one pair of independently movable leg supports which are pivotally connectable to a main body support to raise and lower, either separately and/or together, a user's legs during exercise between upper and lower positions, and means for allowing said at least one pair of independently movable leg supports to be swung in a plane transverse to the plane of the raising and lowering movement of said leg supports.

Preferably said exercise device includes an adjustment device to tilt up or down the operating position of said at least one pair of leg supports. In a further aspect said exercise device includes a base frame which can be moved along a floor and is adapted to be clamped to said floor and a main frame which can be reciprocally moved relative to said base frame. Preferably said means for allowing said at least one pair of independently movable leg supports to be swung in a plane transverse to the plane of the raising and lowering movement of said leg supports includes a turntable having said pair of leg supports attached thereto.

In practical embodiments said exercise devices may include one or more additional exercise components which can be selectively activated by a control means.

Additional exercise components may include a rowing device, a rhythmic movement of said exercise device, an oscillating shoulder pad, a pair of oscillating posterior seats, vibrationary devices, heating devices and any other suitable devices in various combinations. It is preferred that said control means can control individual exercise elements or combinations thereof.

BRIEF DESCRIPTION OF THE DRAWINGS

In order that the invention may be more readily understood and put into practical effect, reference will now be made to the accompanying drawings which illustrate an especially preferred embodiment of the invention. In the drawings.

DETAILED DESCRIPTION OF THE PREFERRED EMBODIMENTS

Figure 1:
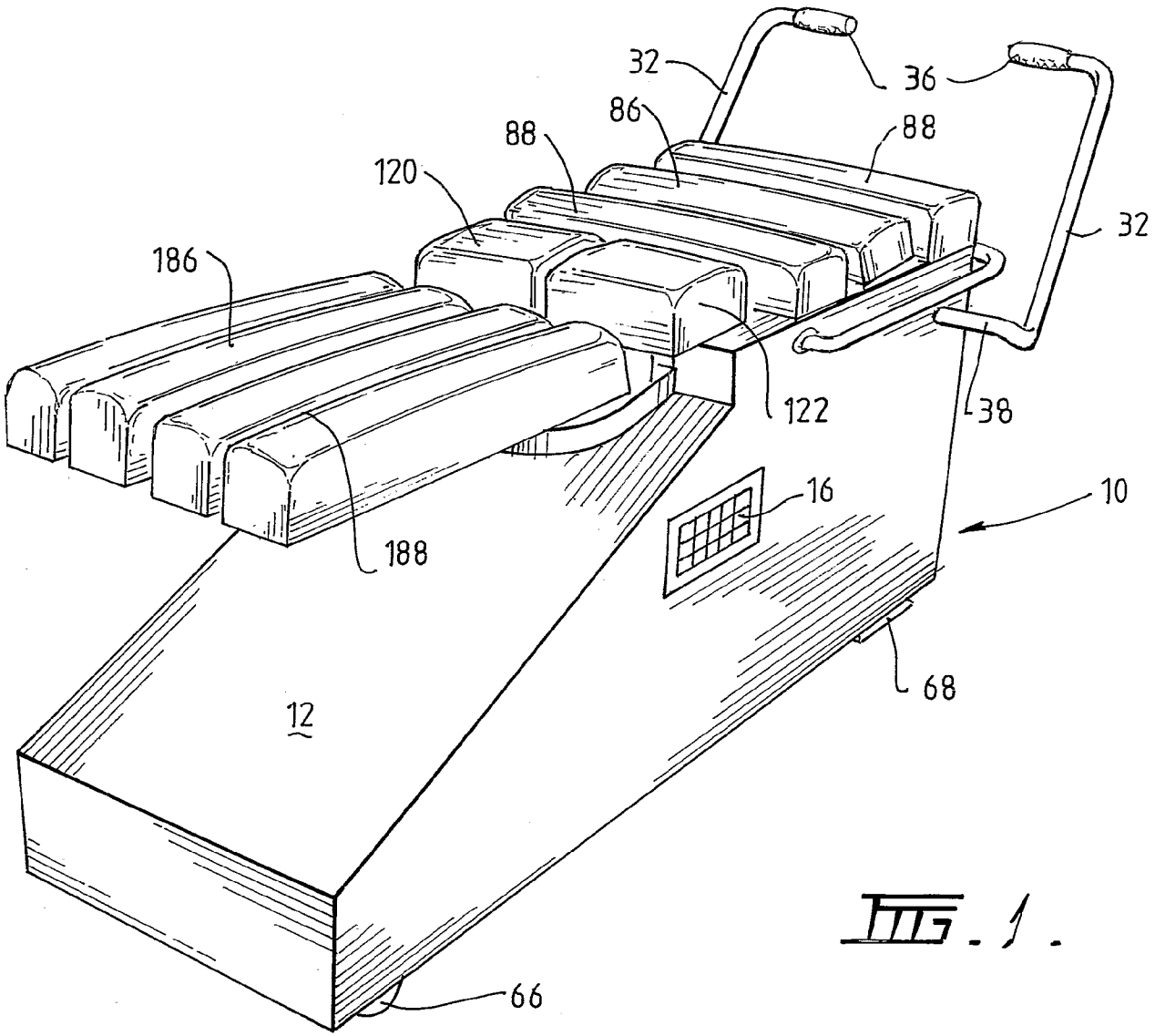
FIG. 1 is a perspective view of an exercise device made in accordance with the invention.
Figure 2:
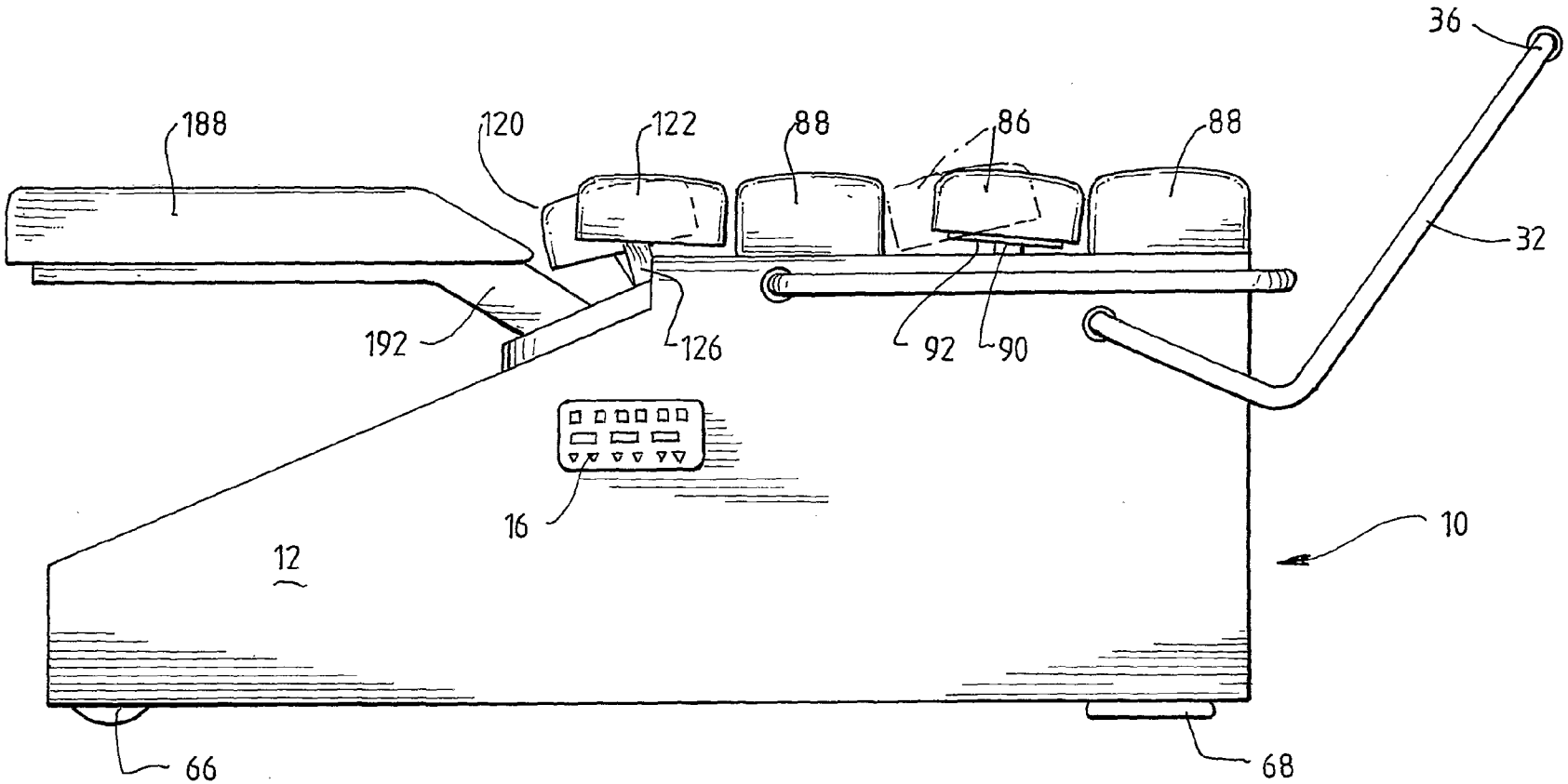
FIG. 2 is a side view of the exercise device shown in FIG. 1.
Figure 3:
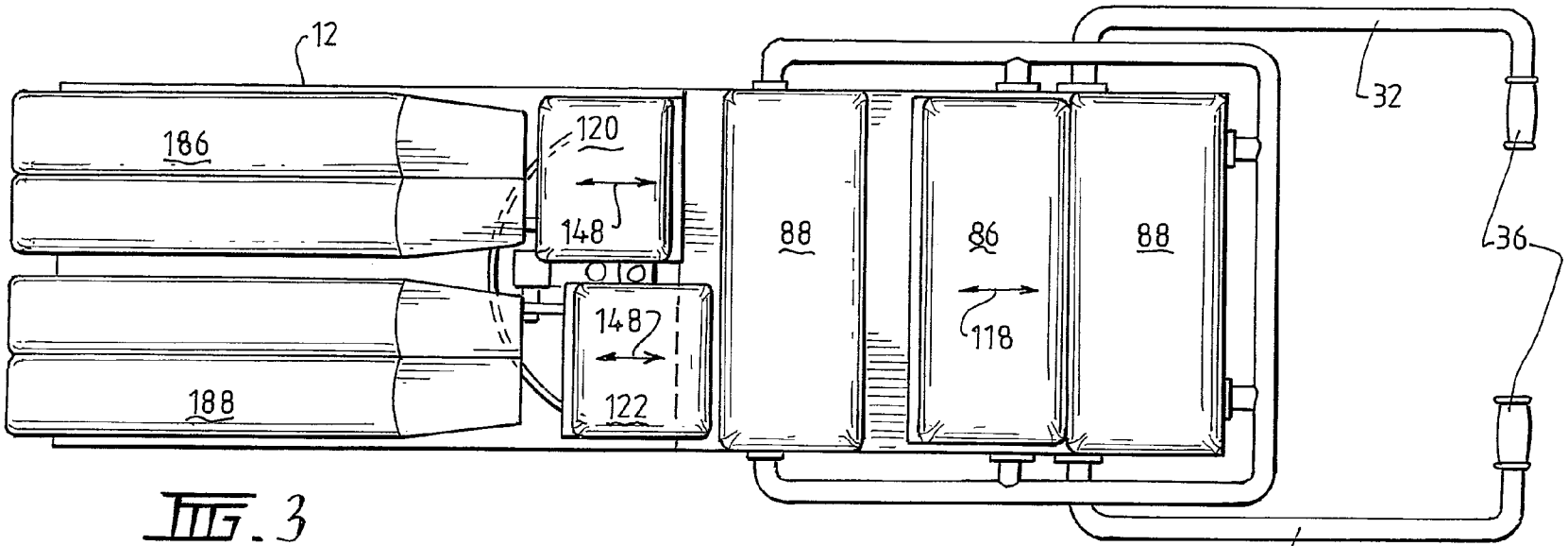
FIG. 3 is a plan view of the exercise device shown in FIG. 1.
Figure 4:
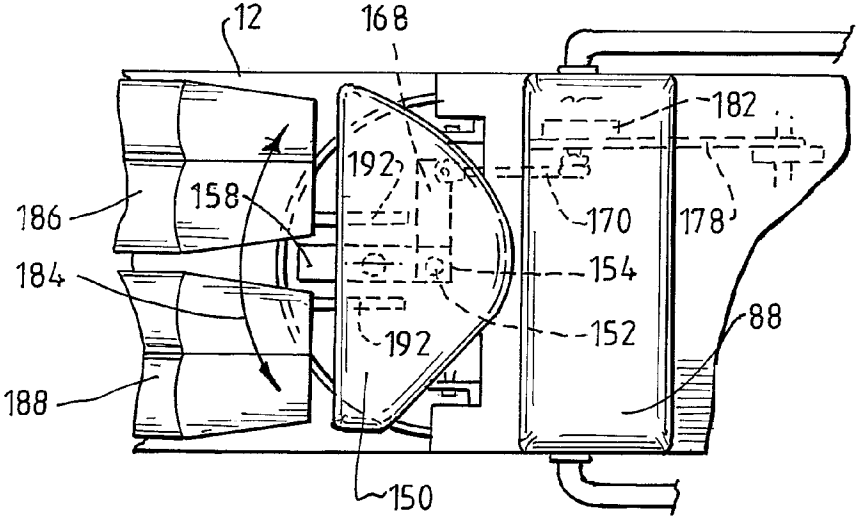
FIG. 4 is a partial plan view similar to that of FIG. 3 showing an oscillating seat option.

In the drawings there is shown an exercise device 10 which is capable of performing many different movements to allow different exercises to be undertaken by a user (not shown). The exercise device 10 has a wedge shaped body 12 formed from various panels which are attached to a main frame 14. A control panel 16 has buttons, switches, etc which, when activated, provide operational control for the various movements realised by the exercise device. The nature of the control panel 16 will not be further described as the switching functions can be programmed or actioned by a skilled electrical engineer. For example, the control panel 16 can be replaced by a touch screen panel mounted on a swivel pendant. The pendant could be swivelable 180° to allow for easy access when programming of the exercise device is required. The required electronics/hydraulics can be housed in a control box 17 inside wedge shaped body 12. If desired, a hand held remote control (not shown) could emulate the functions of control panel 16, or could replace control panel 16. Located inside main frame 14 is a main electric motor 18 coupled to a reduction gearbox 20. A main shaft 22 extends from either side of reduction gearbox 20 to provide the majority of rotation transmission to various components of exercise device 10. A secondary drive shaft 24 is driven by main shaft 22 by sprockets 26, 28 and chain 30.

Figure 5:
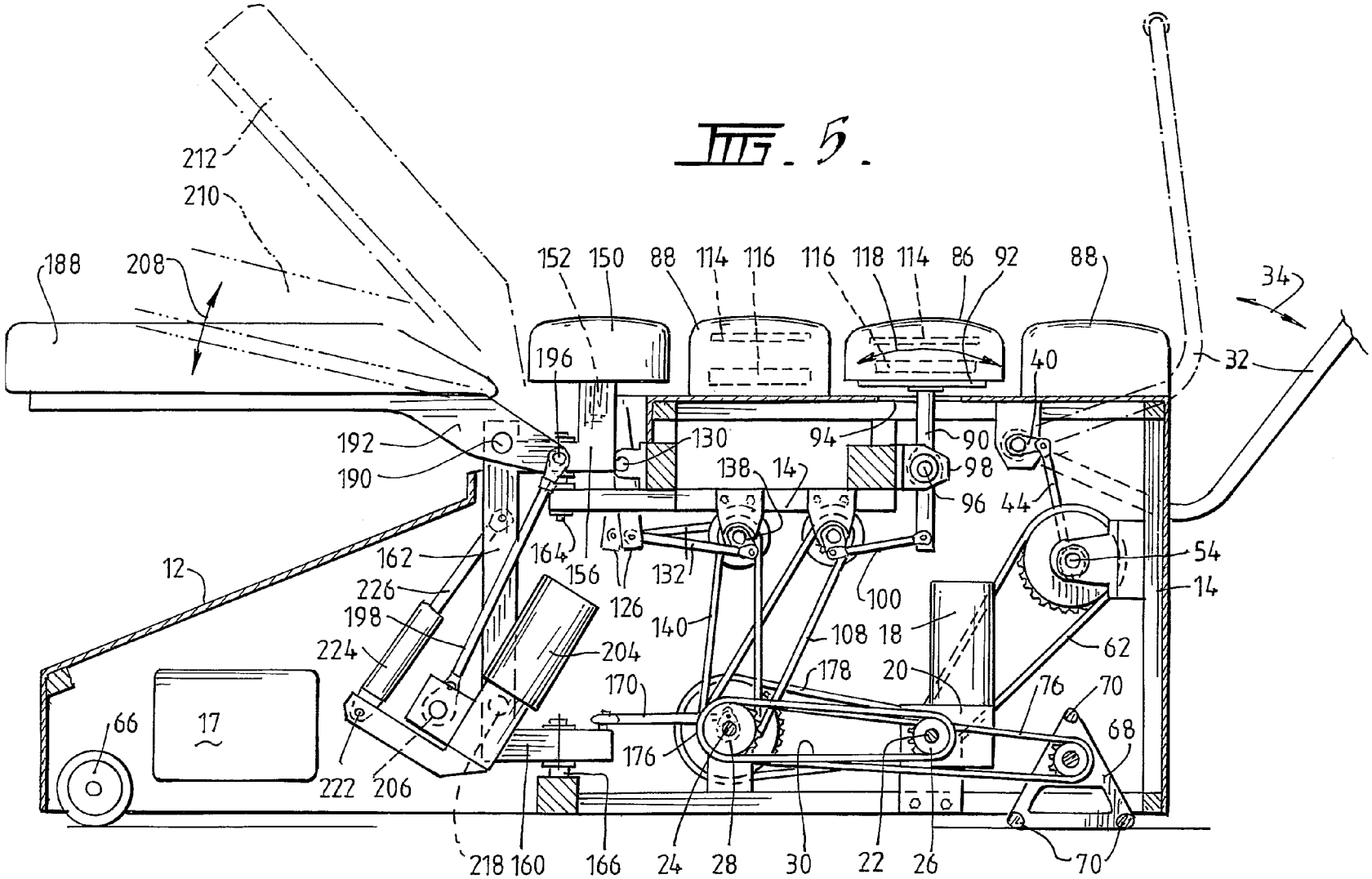
FIG. 5 is a longitudinal cross-sectional view of the exercise device shown in FIG. 1.
Figure 6:
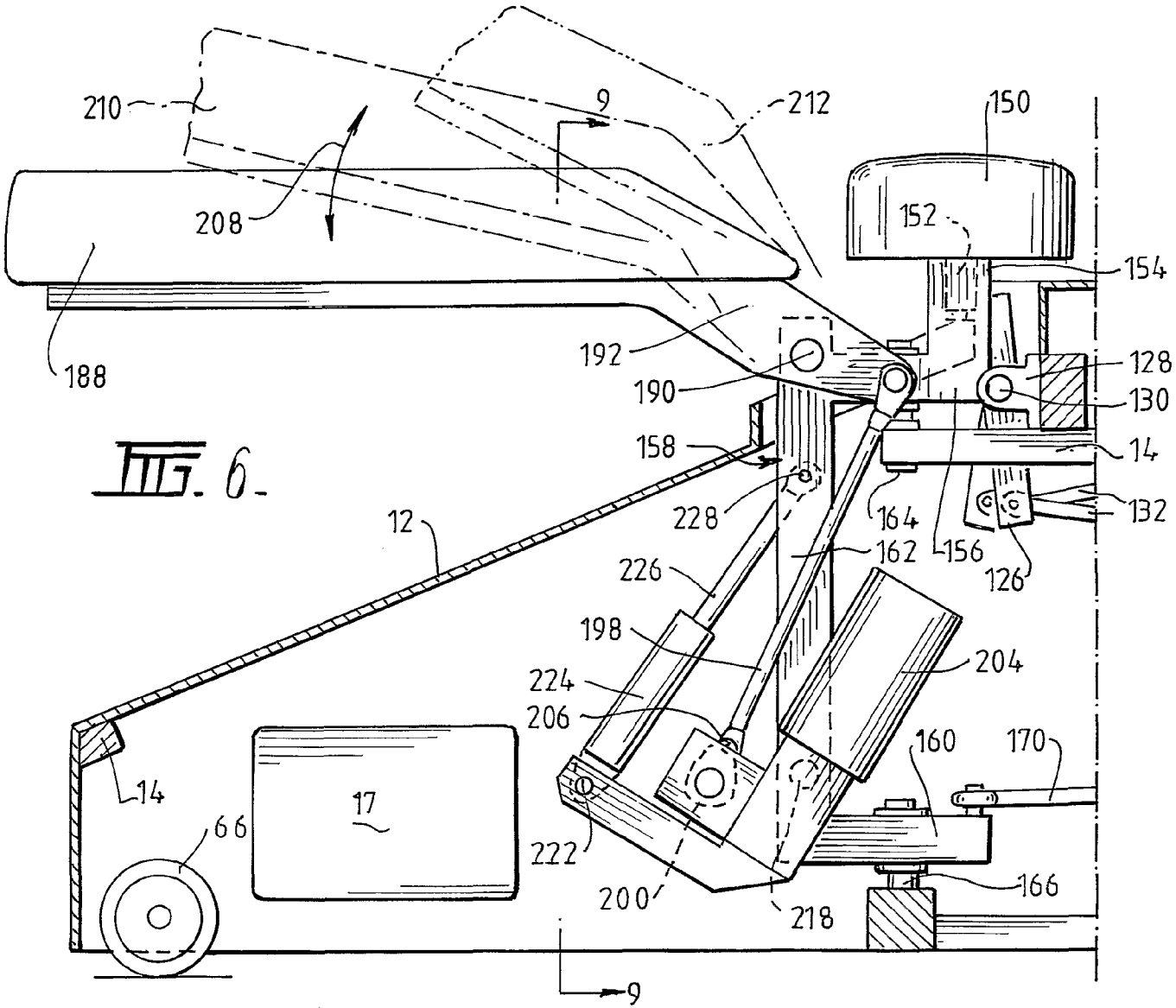
FIG. 6 is an enlarged partial longitudinal cross-sectional view similar to that of FIG. 5 showing one end of the exercise device shown in FIG. 1.
Figure 7:
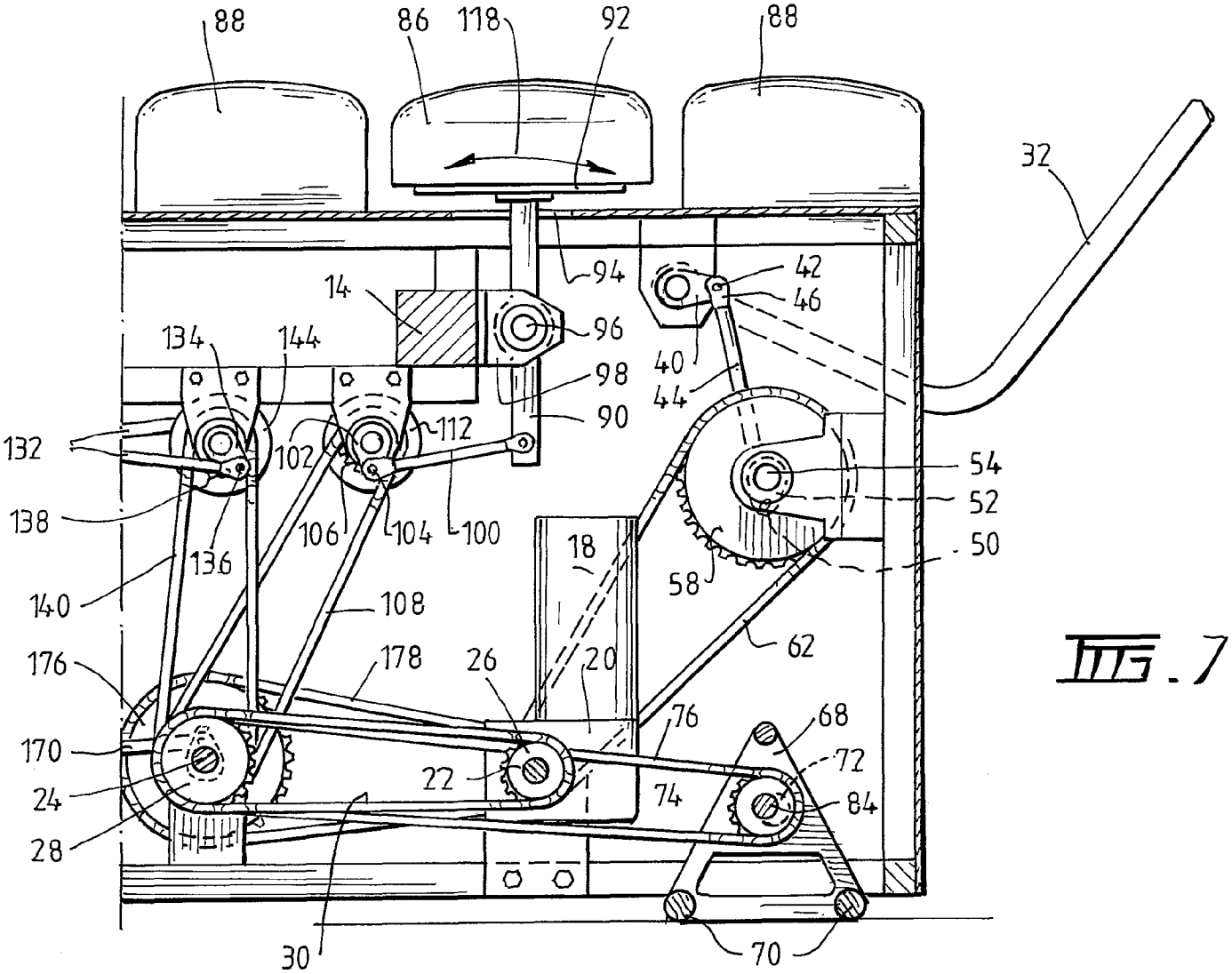
FIG. 7 is an enlarged partial longitudinal cross-sectional view similar to that of FIG. 5 showing the other end of the exercise device shown in FIG. 1.
Figure 8:
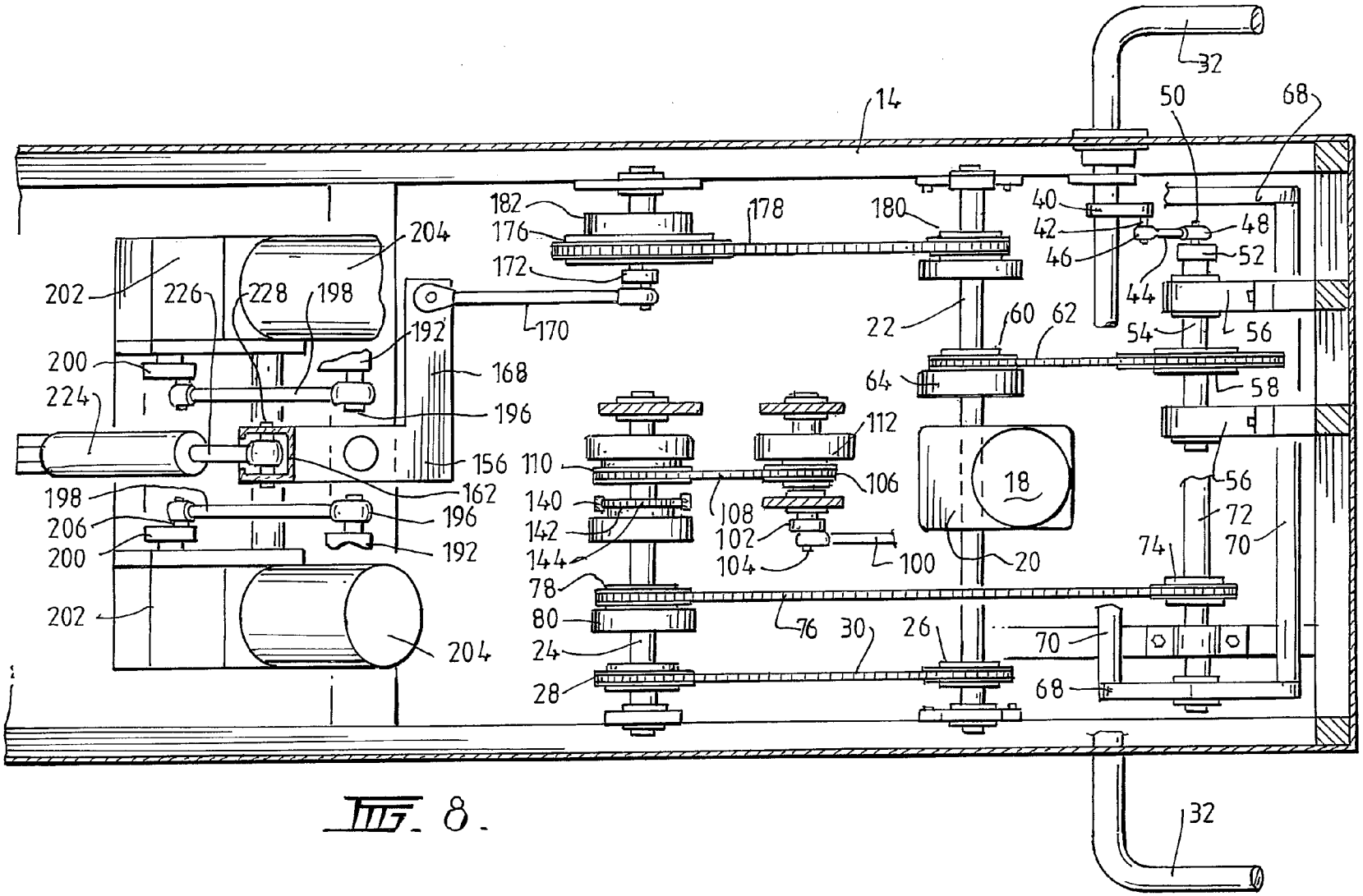
FIG. 8 is a planar cross-sectional view adjacent the top of the exercise device shown in FIG. 1.
Figure 9:
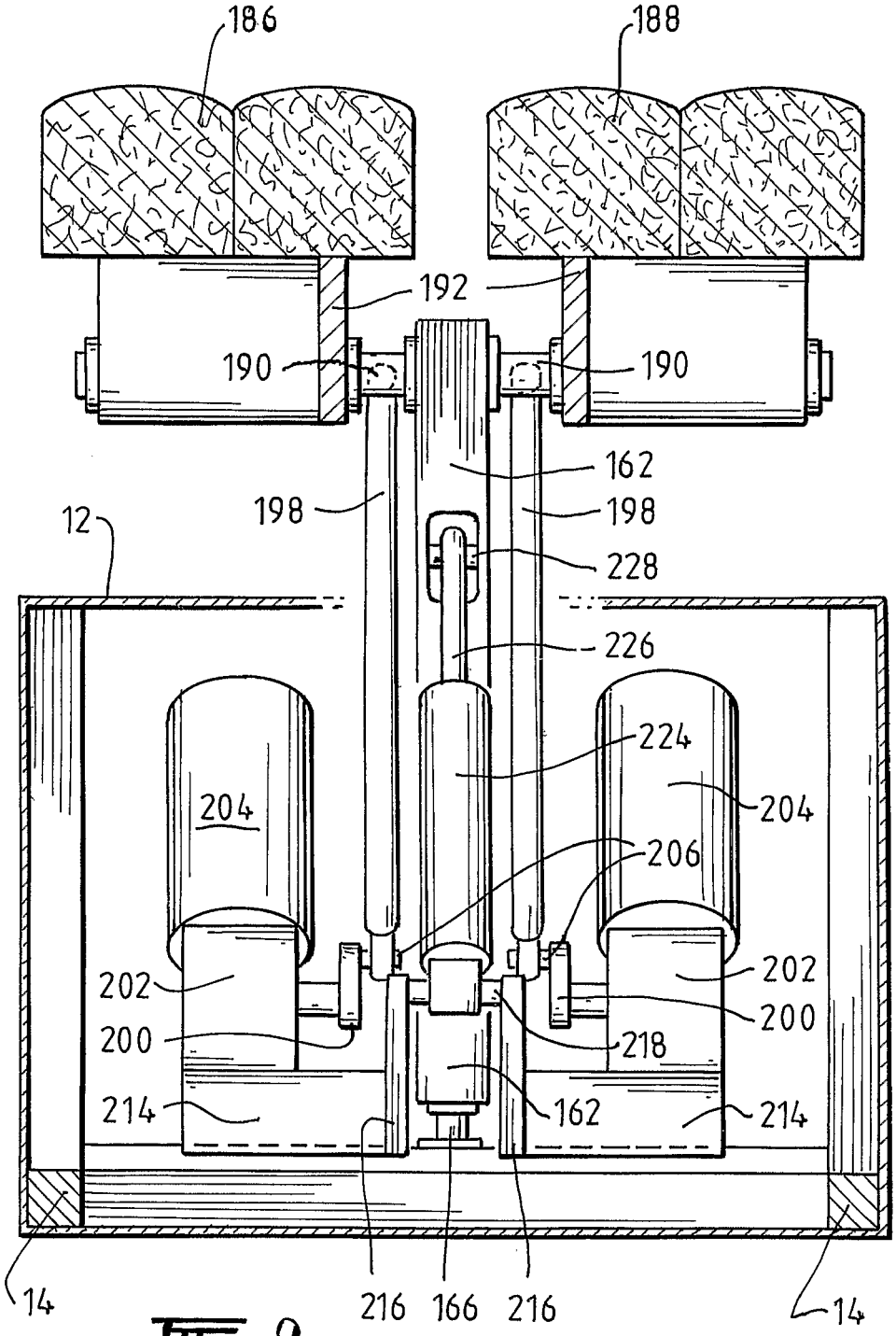
FIG. 9 is a cross-sectional view along and in the direction of arrows 9-9 of FIG. 6.

A first exercise is a rowing exercise where a rowing handle 32 is movable in the direction of arrows 34 (FIG. 5) and shown in faint lines 32*a*. Rowing handle 32 can be any suitable shape, but generally has two rotatable hand grips 36 and a shaft 38 which can be rotated to provide the up and down movement indicated by arrows 34. Shaft 38 is coupled to a lobe 40 having an offset pin 42 which is coupled to a connecting rod 44 at one end 46. The other end 48 of connecting rod 44 is coupled to a further offset pin 50 on a further lobe 52 extending from a rotatable shaft 54 supported by bearings 56. A sprocket 58 is secured to shaft 54 and rotated by sprocket 60 (FIG. 8) via chain 62. A clutch 64 will selectively cause rotation of sprocket 60 from main shaft 22.

In use, when clutch 64 is activated from control panel 16, sprocket 60 will cause rotation of sprocket 58 through chain 62 and shaft 54 will rotate to cause further lobe 52 to rotate and cause a reciprocal motion of connecting rod 44. The connection of connecting rod 44 to lobe 40 on shaft 38 will result in the up and down motion of rowing handle 32. When a user is seated on exercise device 10 and holds hand grips 36, this enables the user to undertake the rowing exercise from a seated position. For a variation, shaft 38 can be split (not shown) to provide independent up and down movement for each rowing handle 32. The split shaft arrangement could have the split shafts driven independently to allow a selection of parallel movements of the rowing handles 32 together, or separately in opposing directions.

A second type of exercise is the rhythmic movement of the exercise device 10 per se. A pair of wheels 66 provides a pivot point for lifting the exercise device 10 from the opposite end. A pair of triangles 68 at the opposite end has link rods 70 at their vertices. Triangles 68 are rotated by a shaft 72 driven by a sprocket 74 through chain 76 via sprocket 78. Sprocket 78 is coupled to secondary drive shaft 24 and is activated through clutch 80 from control panel 16. In order to provide the lift of exercise device 10 from the floor 82, eccentric stub axles 84 from shaft 72 are coupled to triangles 68 in an offset disposition.

In use, when clutch 80 is activated from control panel 16, sprocket 78 will cause rotation of sprocket 74 through chain 76 and shaft 72 will rotate to cause triangles 68 to rotate and lift exercise device 10 from floor 82 by moving a respective vertex along the floor 82. The vertex will slide along the floor through the eccentricity of stub axles 84 to raise exercise device 10 from the floor 82 for the first half of its movement and then lower the exercise device 10 in its second half of its movement. This movement will provide a gentle rocking motion. This motion can be activated in combination with any one of the other exercises to stimulate the blood and lymphatic circulatory systems.

A third type of exercise uses an oscillating shoulder pad 86 which is disposed between two stationary cushions 88. A shaft 90 is secured centrally to a base 92 and projects through aperture 94 of body 12. Shaft 90 has a pivot pin 96 which is attached to brackets 98 on main frame 14. A connecting rod 100 is pivotally attached at one end of shaft 90 and pivotally attached at the other end to a lobe 102 through offset pin 104. Lobe 102 rotates with sprocket 106 through chain 108 via sprocket 110 attached to secondary drive shaft 24. A clutch 112 is activated from control panel 16 for selectively controlling operation of pad 86. If desired, pad 86, or any of the pads, can include a heating coil 114 to take the chill off the pad 86 and a vibratory device 116 to stimulate the blood supply.

In use, when clutch 112 has been activated shoulder pad 86 will oscillate in the direction of arrows 118 in a forwards/backwards motion. Shoulder pad 86 will move in a tilting action through the pivoting action of shaft 90 about pivot pin 96. Shaft 90 will pivot through its coupling to connecting rod 100 and the rotation of offset pin 104 on lobe 102.

A fourth type of exercise uses a pair of oscillating posterior seats 120,122 (FIGS. 1, 2, 3 and 10). Seats 120,122 have stub shafts 124 which are slidably but non-rotatably located in hollow shafts 126. Hollow shafts 126 are pivotally attached to bracket 128 on main flame 14 through pivot pin 130. Hollow shafts 126 are oscillated by a pair of connecting rods 132 pivotally attached at a respective end of shafts 126 and pivotally attached at the other ends to lobes 134 through offset pins 136. Lobes 134 rotate with sprockets 138 through chain 140 via sprockets 142 attached to secondary drive shaft 24. A clutch 144 is activated from control panel 16 for selectively controlling operation of seats 120,122.

The operational movement of seats 120,122 is identical to that of the movement of shoulder pad 86 and, accordingly, does not have to be repeated. Seats 120,122 will move in opposing directions as indicated by arrows 146,148. Seats 120,122 are removable from shafts 126 to allow the use of a fifth exercise option.

The fifth exercise option is a single swivelable seat 150. Seat 150 has a stub shaft 152 which is slidably but non-rotatably located in a hollow bore of extension arm 154. Extension arm 154 extends at right angles from the top side arm 156 of a C-shaped support 158. C-shaped support 158 has a lower side arm 160 and a link arm 162. Side arms 156,160 are pivotally attached to frame 14 by pivot pins 164,166 respectively. A further extension arm 168 extends from lower side arm 160 in the manner of a bell crank and is pivotally attached at its free end to a connecting rod 170. Connecting rod 170 is pivotally attached at its other end to a lobe 172 through offset pin 174. Lobe 172 rotates with sprocket 176 through chain 178 via sprocket 180 attached to main drive shaft 22. A clutch 182 is activated from control panel 16 for selectively controlling operation of seat 150.

In use, when clutch 182 has been activated seat 150 will swivel in the direction of arrows 184 in a swivelling sideways motion. C-shaped support 158 will pivot around pivot pins 164,166 through its coupling to connecting rod 170 and the rotation of offset pin 174 on lobe 172. As seat 150 is located within extension arm 154 on C-shaped support 158, seat 150 will move in its swivelling sideways motion.

A sixth exercise option is a pair of leg raisers in the form of padded longitudinal leg supports 186,188. Supports 186,188 can be any suitable shape and are not restricted to the bi-pillow arrangement shown. Each support 186,188 is pivotally attached to axle 190 on either side of link arm 162 of C-shaped support 158 in a lever action. A frame element 192 provides a pivot arm 194 which at each respective free end is pivotally attached to a respective link 196. Each link 196 is pivotally coupled to a respective connecting rod 198. A respective rotatable lobe 200 is driven by a respective gear box 202 through electric motors 204. Offset pins 206 on each lobe 200 will allow a reciprocal motion when lobes 200 are rotated. As each support 186,188 is connected to a separate electric motor 204 each support 186,188 can be moved independently of the other.

In use, each leg support 186,188 can be raised and lowered in an up and down motion as indicated by arrow 208. The phantom lines 210,212 indicate this movement. Each electric motor 204 is activated from control panel 16 to allow the leg supports 186,188 to be raised together, or in opposite directions. Rotation of lobes 200 from gearboxes 202 will allow connecting rods 198 to move up and down and through the pivotal connections of links 196 allow pivot arms 194 to raise and lower leg supports 186,188 about axle 190 in a lever action. As leg supports 186,188 are pivotally attached to link arm 162 through axle 190, the leg supports will also move in synchronism when seat 150 is activated.

The position of leg supports 186,188 can also be varied. Each gearbox 202 is secured to a base plate 214 and a swing plate 216. Each swing plate 216 is coupled to a pivot pin 218 through link arm 162. An extension arm 220 is mounted perpendicular to base plates 214 to provide a pivot 222 at the free end of extension arm 220. A hydraulic cylinder 224 is attached to pivot 222 at one end and to the end of piston 226 of hydraulic cylinder 224 at the other end. Piston 226 is attached to link arm 162 through pivot pin 228.

Figure 10:
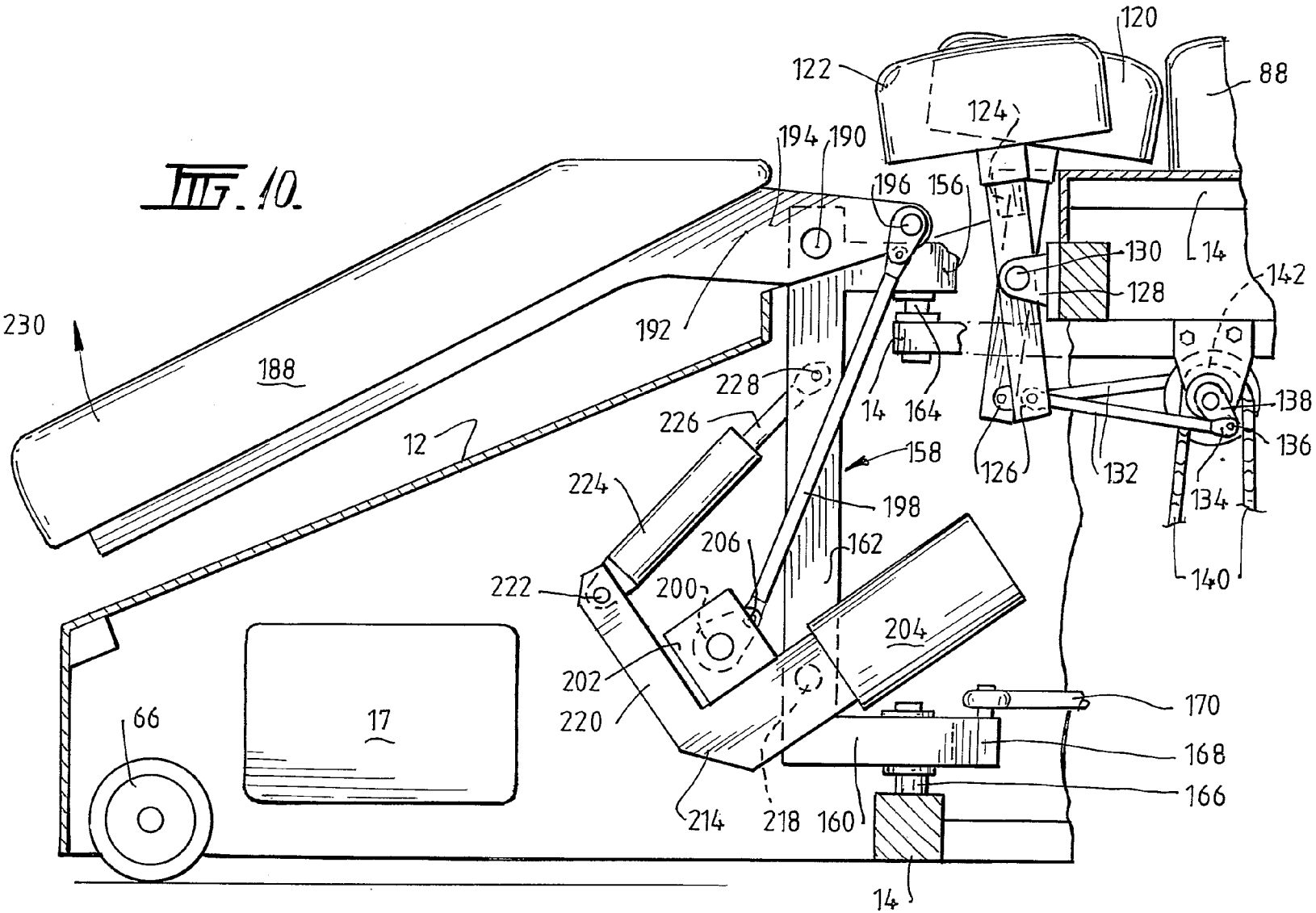
FIG. 10 is a similar view to that of FIG. 6 showing adjustment of the leg members of the exercise device shown in FIG. 1.

The operation to vary the starting position for the leg supports 186,188 will now be described. Turning to FIG. 10, leg supports 186,188 are at their lowest angle. When connecting rod 198 raises and lowers leg supports 186,188 they will move between the position shown in FIG. 10 to a horizontal position. To allow movement from the horizontal position to the position shown by 212 in FIG. 5, hydraulic cylinder 224 can be actuated from control panel 16. The outward movement of piston 226 will cause motors 204 to rotate anticlockwise (FIG. 10) and lower the position of gearboxes 202. Connecting rod 198 will be pulled downwardly causing leg supports 186,188 to be raised as indicated by arrow 230. The length of extension of piston 226 from hydraulic cylinder 224 will determine a new lowermost position for leg supports 186, 188.

In an alternative arrangement (not illustrated) a single motor—with associated control apparatus—can be employed to allow for the desired movement of the leg supports 186, 188, either separately or in unison.

The preferred embodiment includes a plurality of exercise components which can be operated independently or in various combinations to suit requirements. Although the preferred embodiment describes the use of sprockets, chains, lobes, offset pins, connecting rods the invention is not limited to that particular type of construction or operation. It is clear to the man skilled in the art that there are many options for providing the various movements required by the exercise components and accordingly, the invention is not limited to the particular constructions or operations shown. The exercise device described could include all the options described in the preferred embodiment or a sub-set thereof.

Further modifications and additions may be made to the overall device in accordance with the invention, as for example by the incorporation of means/equipment allowing the user to perform exercises additional to those previously described. In particular a further pair of leg supports may be provided at the other end of the device, that is the end remote from the leg supports 186, 188. Once again, this further pair of leg supports is adapted to be movable either separately or together.

FIGS. 11 to 20 show a second embodiment of an exercise device. The same reference numerals have been used for similar components to reduce repetition of description.

The exercise device in FIGS. 11 to 20 has a rectangular base frame 338 and a main frame 340 on which most components are fitted. Base frame 338 has wheels 342 which allows the exercise device to be readily moved into position. Once in position, the exercise device can be set into a locked non-movable position on floor 82 by releasable locking clamps 344. Main frame 340 can be moved in a reciprocal movement relative to base frame 338 by lineal bearings 346 which link the base frame 338 to main frame 340. The relative movement is a result of a coupling of one end of link arm 348 to a pin 350 which is affixed to base frame 338. The other end of link arm 348 is coupled to a radially offset pin 352 on pulley 354 rotatably attached to main frame 340. Pulley 354 is driven by clutch 356 which is powered by motor 358. The backwards and forwards motion caused by the relative movement of base frame 338 with respect to main frame 340 will provide a gentler rocking motion than the triangles 68 of the first embodiment.

The longitudinal leg supports 186, 188 are operated in a different manner to the leg supports 186, 188 shown in FIGS. 1 to 10 of the first embodiment. Each leg support 186, 188 is pivotally attached through pins 360 to brackets 362 secured to arm member 364. Arm member 364 is pivotally mounted about pivot pin 366 which is attached to a support 368 projecting from a frame element 370. Frame element 370 is connected to a turntable frame 372 which rotates with pin 374. Pin 374 is coupled to arm 376 which causes rotation of pin 374 through the backward and forward motion of arm 376. Arm 376 is attached to crank 378 which is moved by link arm 380. Link arm 380 is coupled to a bell crank 382 from clutch 384 which is driven by motor 18. Accordingly, arm member 364 and turntable frame 372 will rotate by movement of arm 376 about bearing 386 attached to main frame 340. In this manner, leg supports 186, 188 together with seats 120, 122 can be swivelled from side to side to provide a twisting exercise for the back.

Leg supports 186, 188 can be moved in a scissor action or together. The leg supports 186, 188 do not require separate motors as described in FIGS. 1 to 10 but obtain their movement from motor 18. Clutches 388 drive pulleys 390 through chains 392 with bell cranks 394 linked to drive arms 396. The other ends of drive arms 396 are pivotally attached to extensions 398. Rotation of bell cranks 394 will result in upward and downward pivotal movement of leg supports 186, 188.

Seat 122 and leg supports 186, 188 can also be raised and lowered together as best seen in FIG. 1 IA. Turntable frame 372 and arm member 364 can be pulled from the position shown in FIG. 11, to the position shown in FIG. 1 IA through the pivoting about arm 376. The pivoting is caused by ring 400 which surrounds a sleeve 402 over pivot pin 366. Ring 400 is coupled to a potentiometer 404 and a linear actuator 406 which are pivotally held at their other ends on bracket 408 secured to main frame 340. As can be seen from FIG. 1 IA, retraction of rod 412 of linear actuator 406 will cause seat 122 and leg supports 186, 188 to be pulled downwardly, which is the lower plane for several of the exercises. It will also allow the exercise device to be used as a flexion/distraction table for treatment of a patient with a prolapsed disc. By controlled movement of linear actuator 406 additional leg movement exercises are possible as well. The linear actuator 406 will also allow the operating position of leg supports 186, 188 to be set at a particular angle, or allow a predetermined degree of lowering of leg supports 186, 188 and seat 122 to occur. Leg supports 186, 188 are independent of one another and can have their movements controlled independently in both the horizontal and vertical dispositions as required. It is also preferred that the leg supports 186, 188 automatically return to their neutral position i.e. horizontally disposed in a straight-ahead position when the particular exercise has been completed. In this position, leg supports 186, 188 are locked and held by a hand operated, side locking device (not shown).

In FIGS. 15 to 20 there is shown a knee extension device 300 at one end—of the exercise device 10. A pair of foot plates 302 are attached to a tube or rod 304 through an arm 306. The tubes or rods 304 slide within a bearing block 308, which is secured, to a main frame 310. At the opposite end of tube or rod 304 is a connecting crank 312, which is pivotally mounted between tube or rod 304 and an endless chain 314. Chain 314 is located on sprockets 316, 318 attached to rotatable shafts 320, 322. Shafts 322 are connected to clutches 324 through chain 328 and pulley 326. A rotatable shaft 330 rotates clutches 324 and is driven by chain 332, which is coupled to the main electric motor 18.

In use, knee extension device 300 can be used in conjunction with rowing handles 32 for combination exercises using the arms and legs together simultaneously. The hands hold the rowing handles 32 and the feet are placed on the foot plates 302. The foot plates 302 are moved backwards and forwards together, singly or in an alternate manner depending on the exercise selection. As tubes or rods 304 are connected to connecting crank 312, rotation of sprockets 316, 318 will cause the reciprocal motion of tubes or rods 304 as indicated by arrows 334 and shown in phantom lines on FIG. 17. Connecting crank 312 will be moved with endless chain 314 between sprockets 316, 318. This movement will cause tubes or rods 304 to be withdrawn or extended through bearing block 308. If required, tubes or rods 304 can be telescopically configured, as shown, to allow for adjustment of the length of movement.

Figure 15:
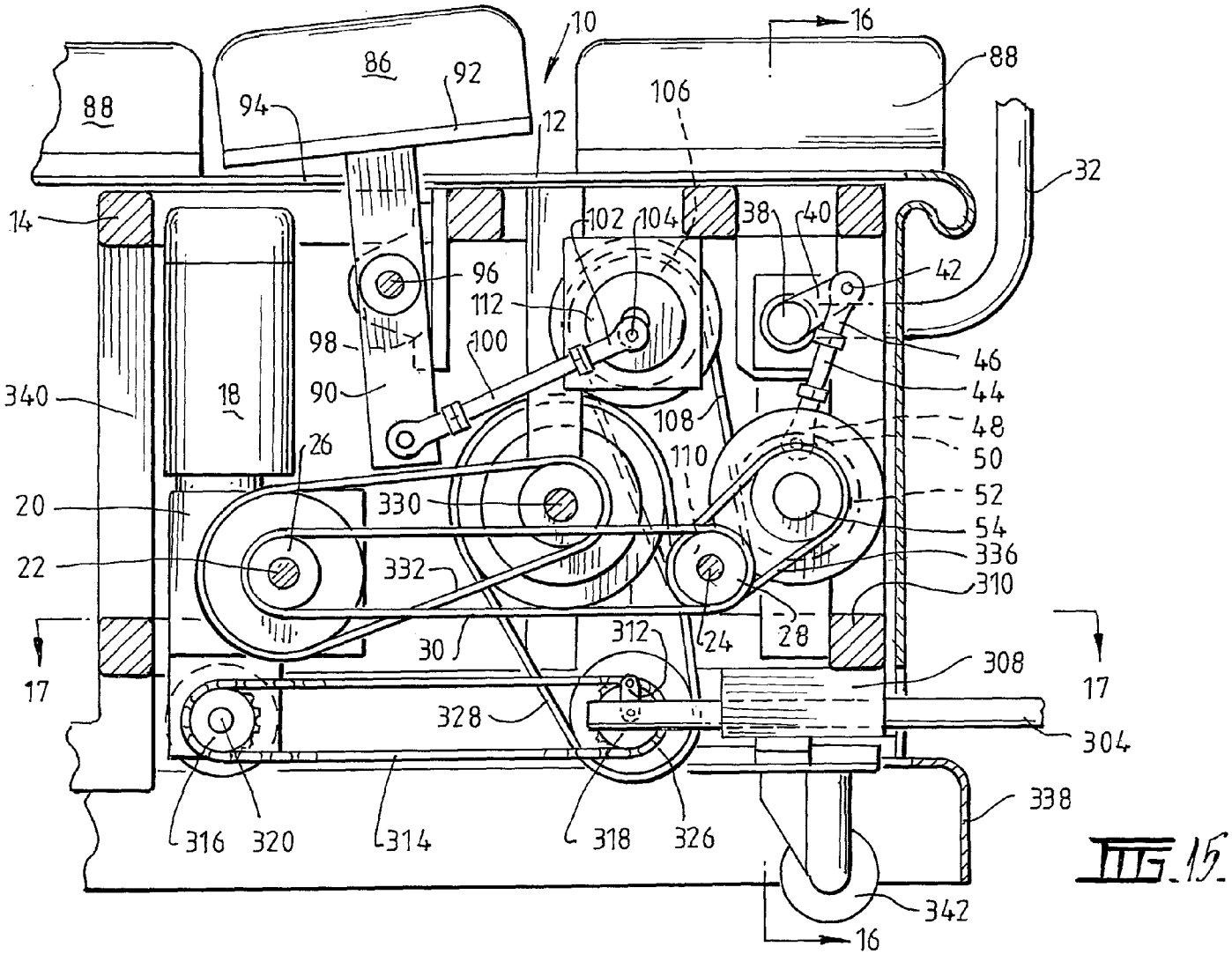
FIG. 15 is a view similar to FIG. 7 of the second embodiment of the exercise device.
Figure 16:
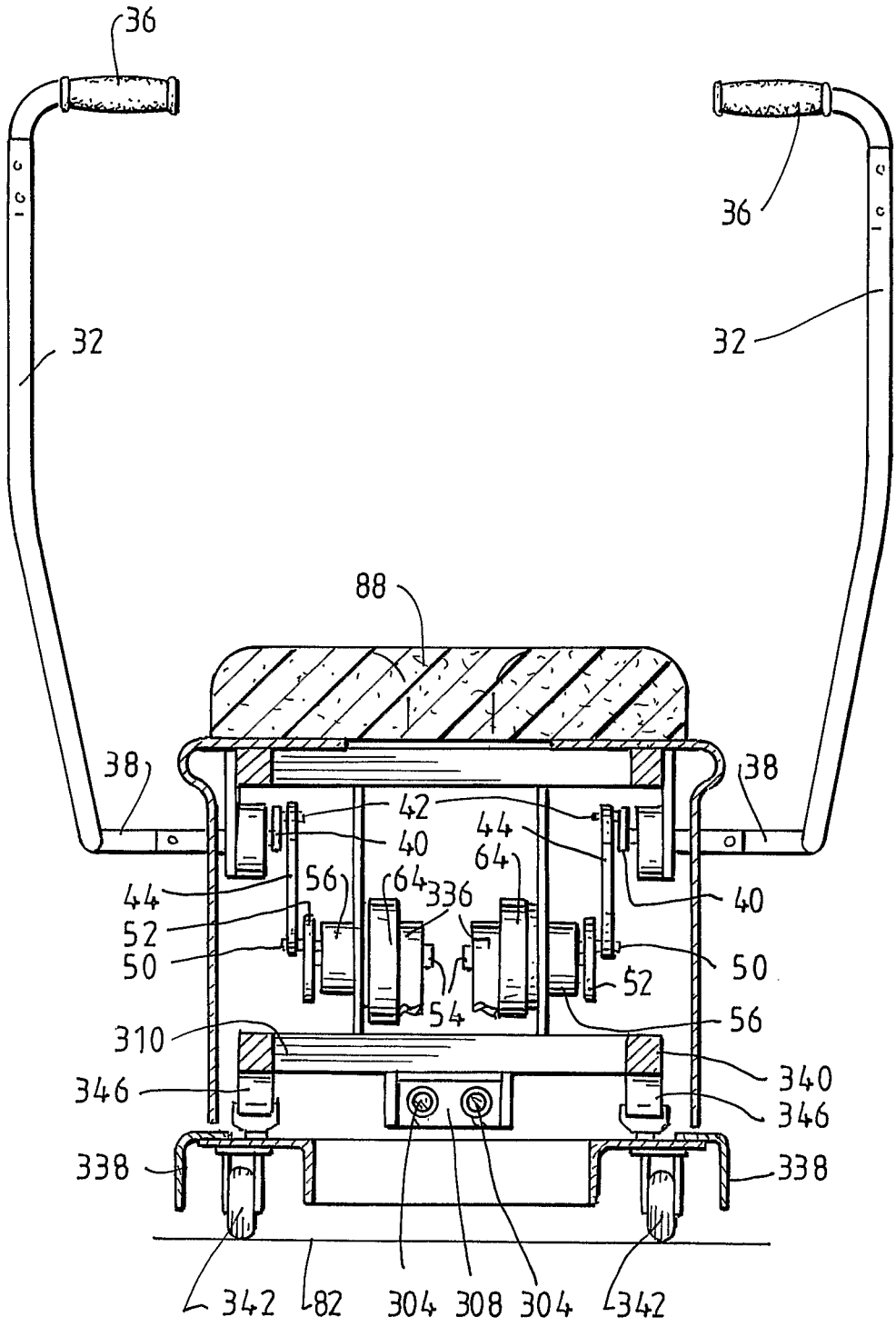
FIG. 16 is a cross-sectional view along and in the direction of arrows 16-16 of FIG. 15.
Figure 17:
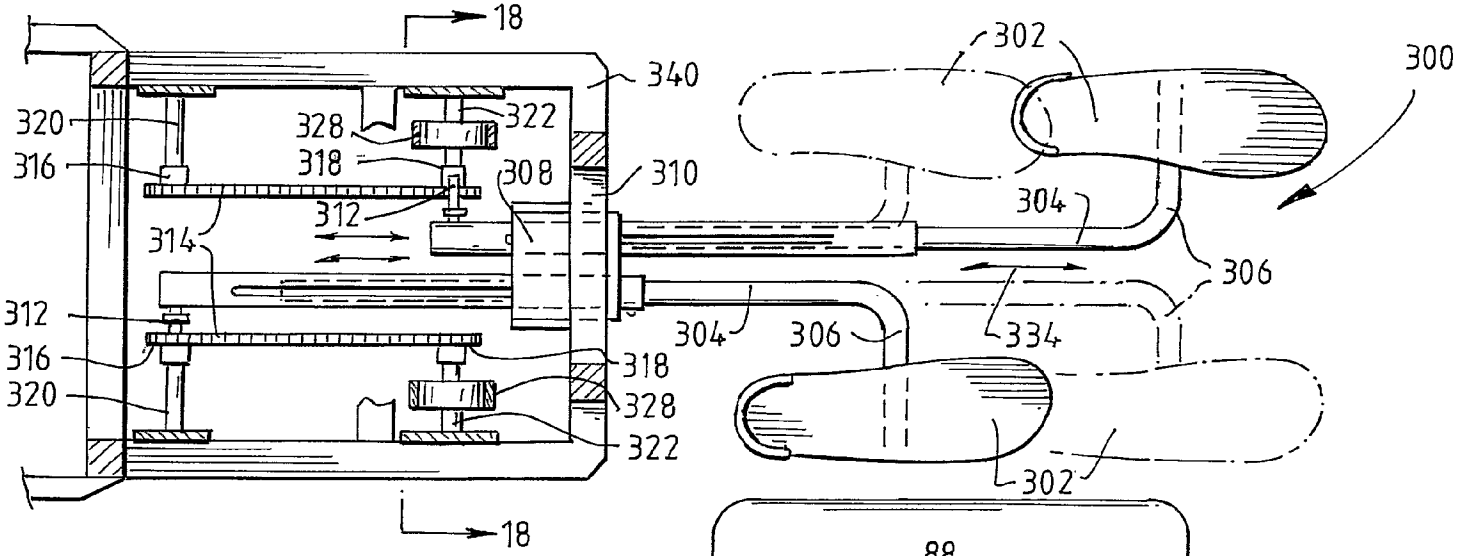
FIG. 17 is a cross-sectional view along and in the direction of arrows 17-17 of FIG. 15.
Figure 18:
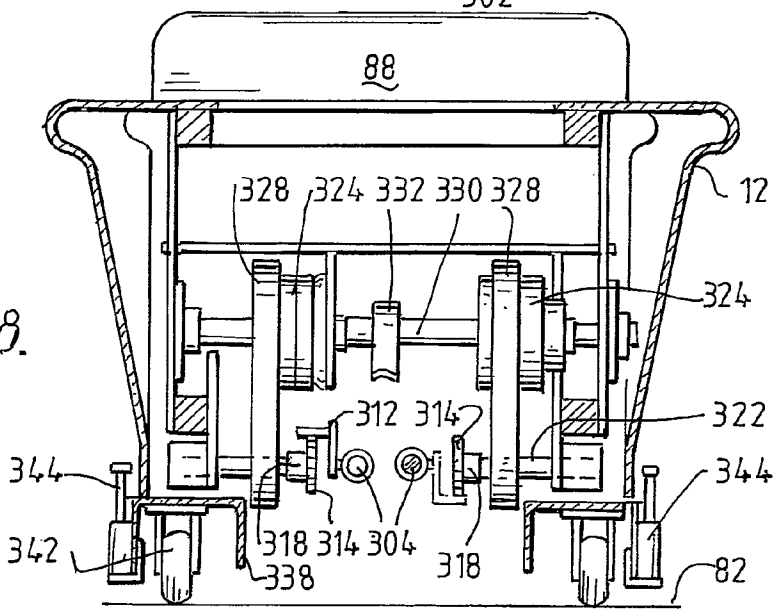
FIG. 18 is a cross-sectional view along and in the direction of arrows 18-18 of FIG. 17.
Figure 19:
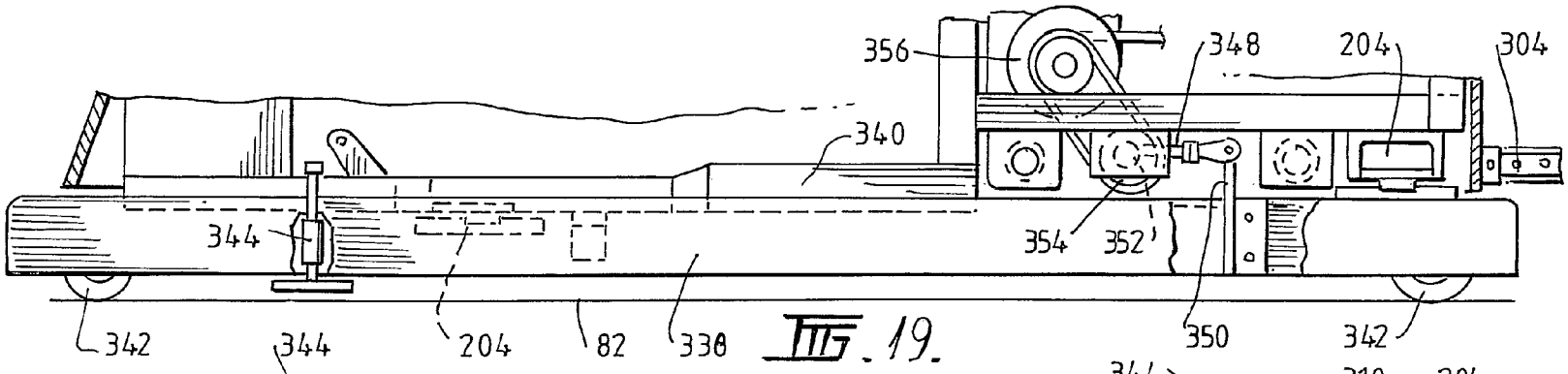
FIG. 19 is a side view of the lower support frame of the second embodiment of the exercise device.
Figure 20:
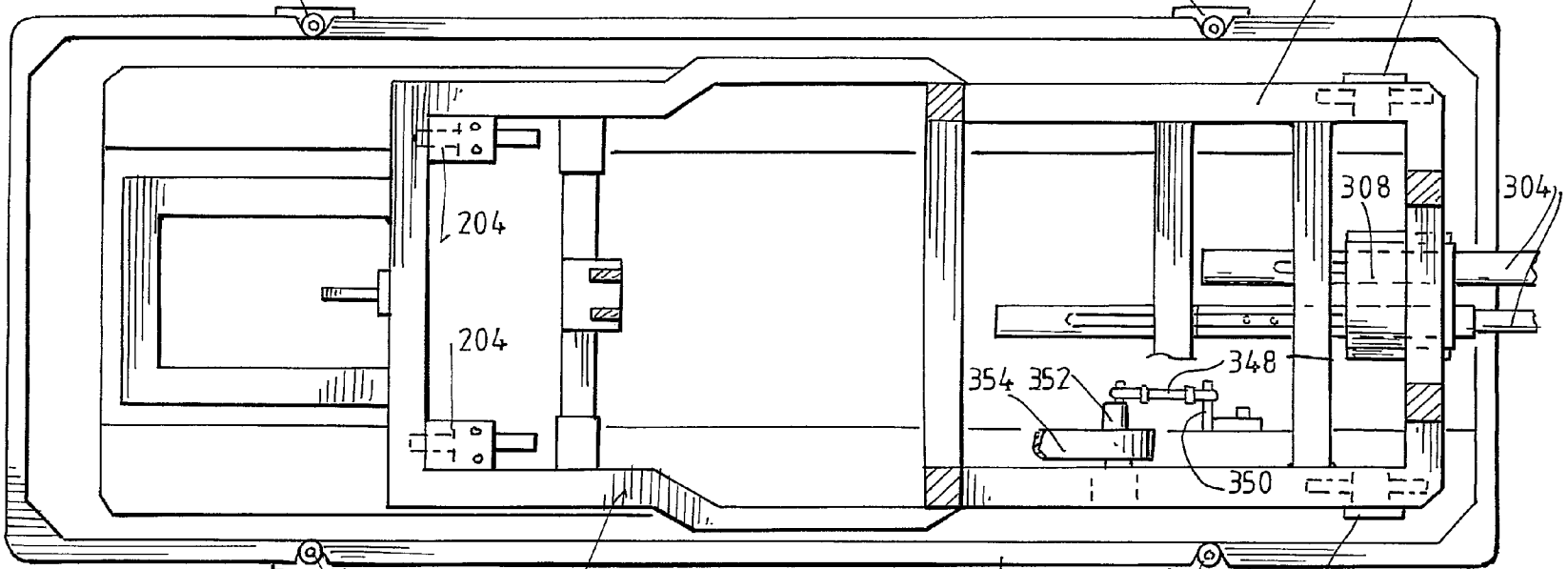
FIG. 20 is a plan view of the upper and lower frames of the second embodiment of the exercise device.
Figure 21:
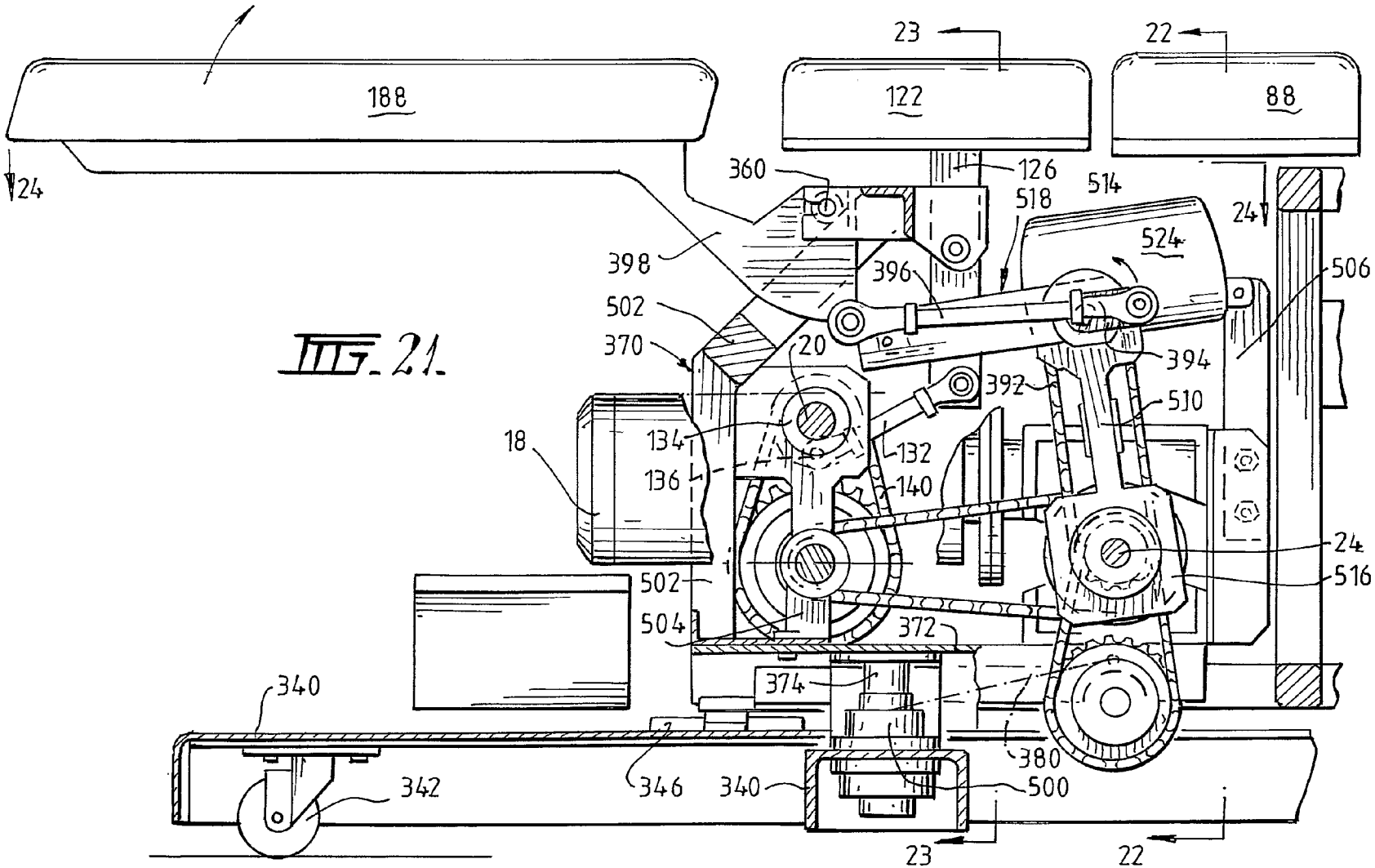
FIG. 21 is a view similar to FIG. 6 of a third embodiment of an exercise device made in accordance with the invention.
Figure 22:
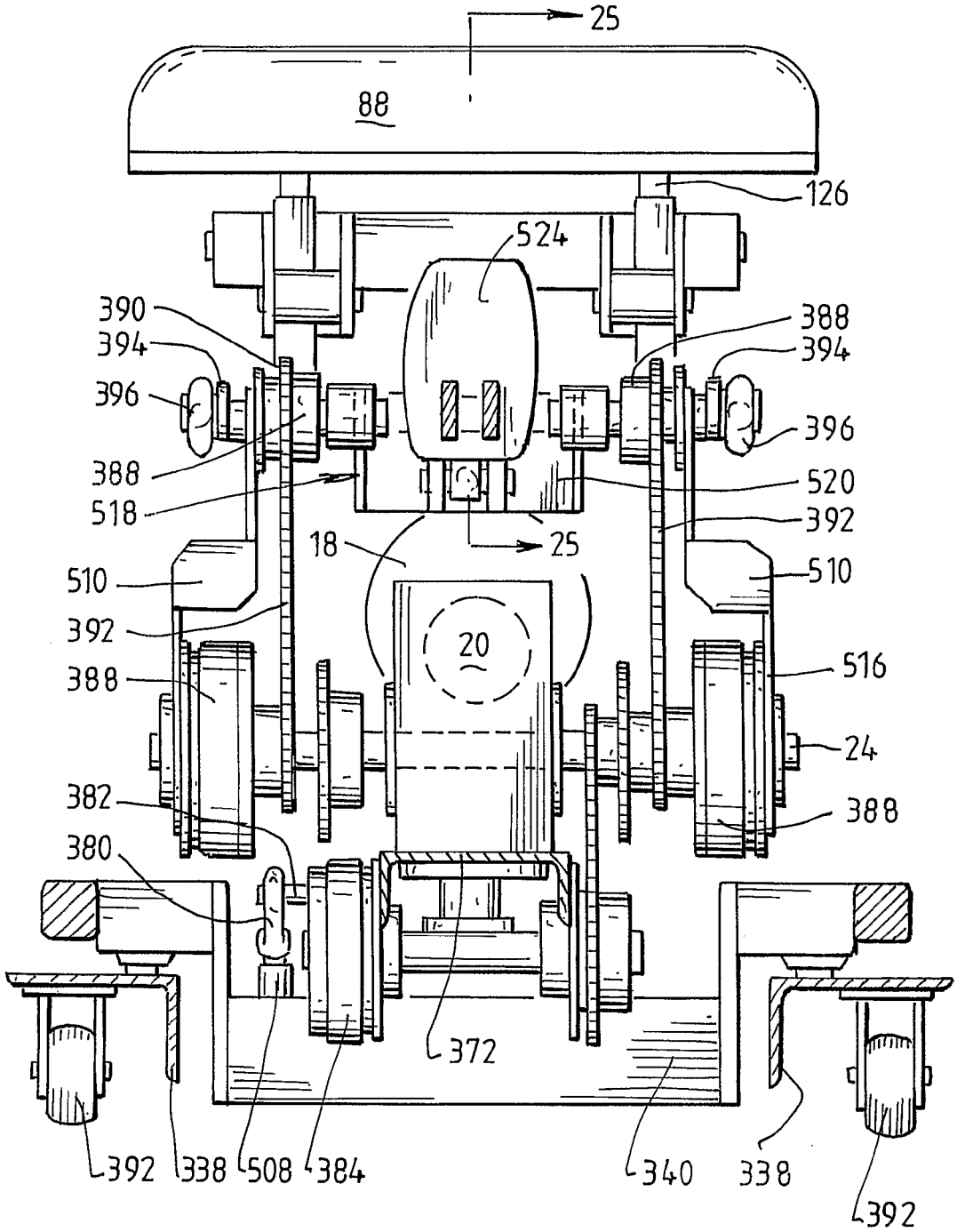
FIG. 22 is a cross-sectional view along and in the direction of arrows 22-22 of FIG. 21.
Figure 23:
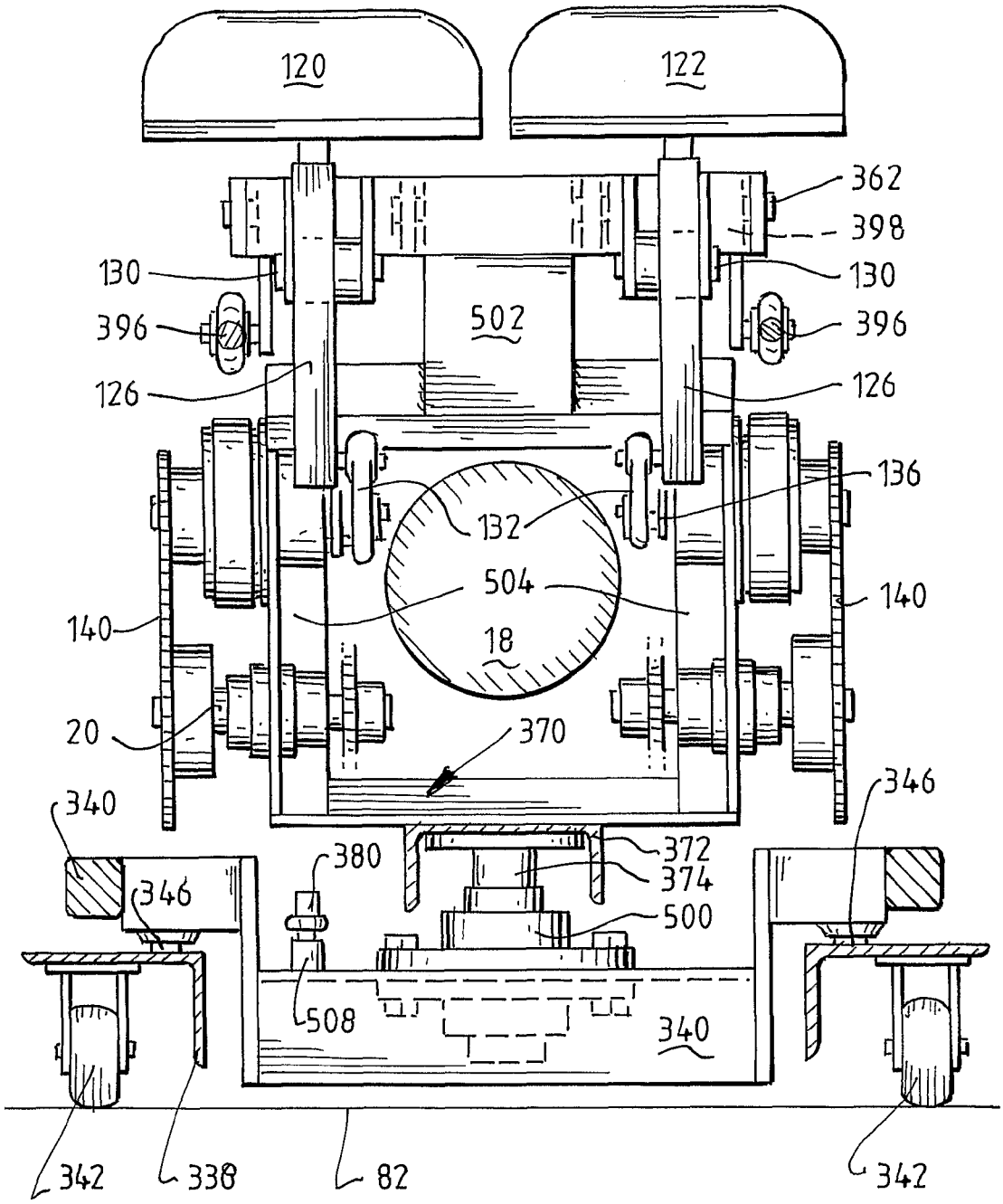
FIG. 23 is a cross-sectional view along and in the direction of arrows 23-23 of FIG. 21.
Figure 24:
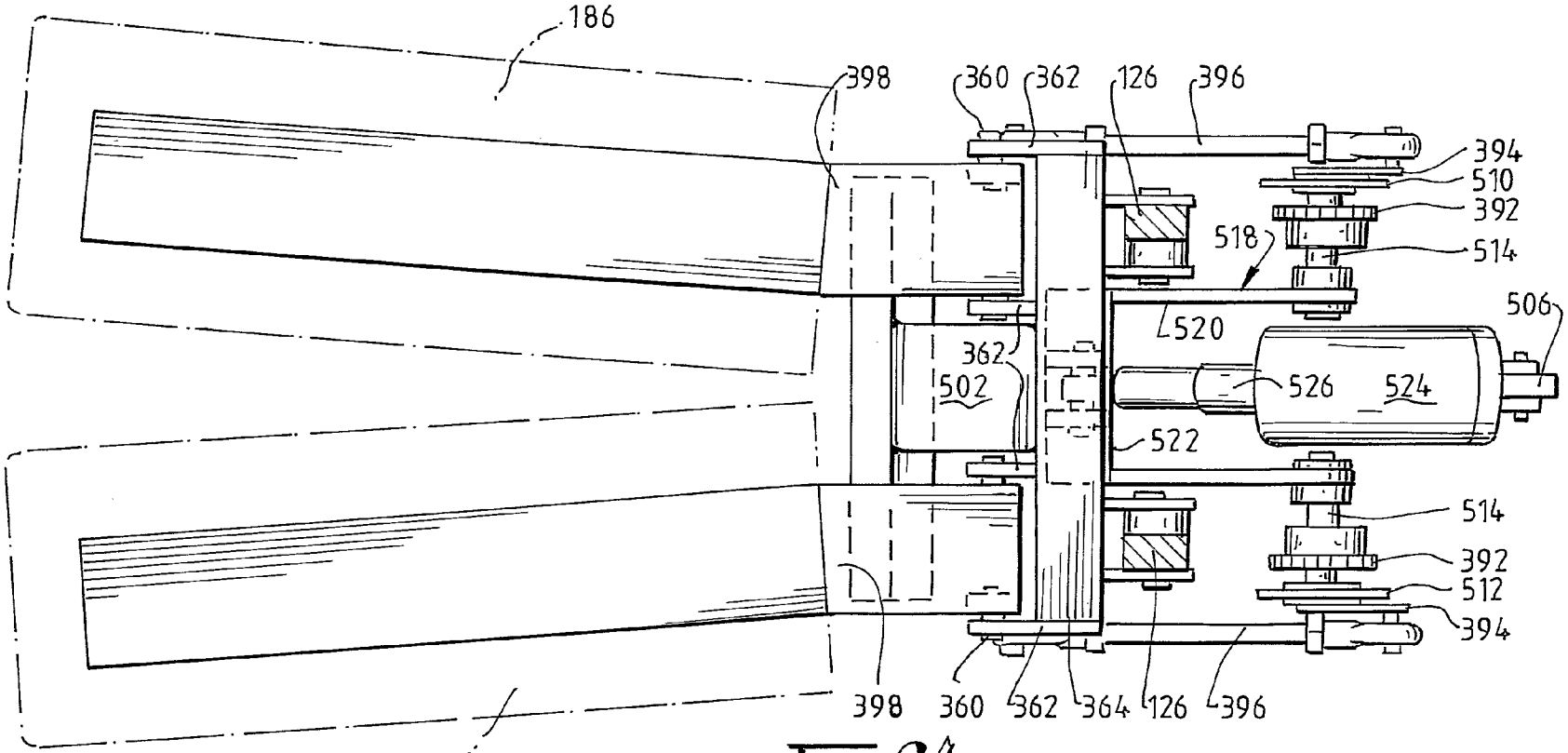
FIG. 24 is a cross-sectional view along and in the direction of arrows 24-24 of FIG. 21.

The rowing exercise device shown in FIGS. 15 and 16 is very similar to that shown in the first embodiment and similar reference numerals have accordingly been used. The embodiment shown in FIGS. 15 and 16 has individual control for both rowing handles 32 as each is coupled to respective clutches 64. Clutches 64 are driven by belts 336 via pulleys on main shaft 22. In all embodiments the length of rowing handles 32 may be adjustable e.g. by telescopic sleeves to suit the differing sizes of the participant.

Figure 11:
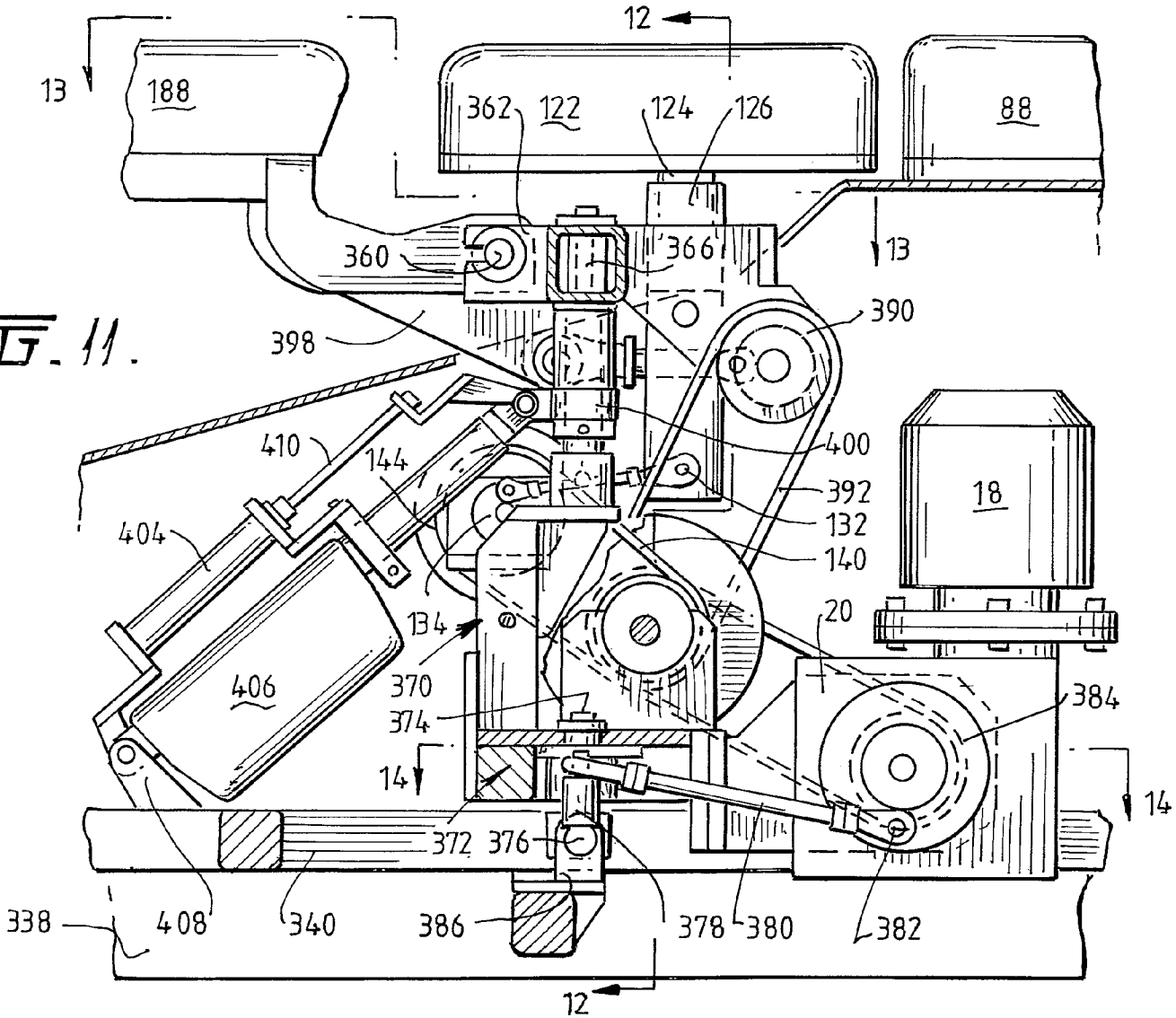
FIG. 11 is a view similar to FIG. 6 of a second embodiment of an exercise device made in accordance with the invention.
Figure 11A:
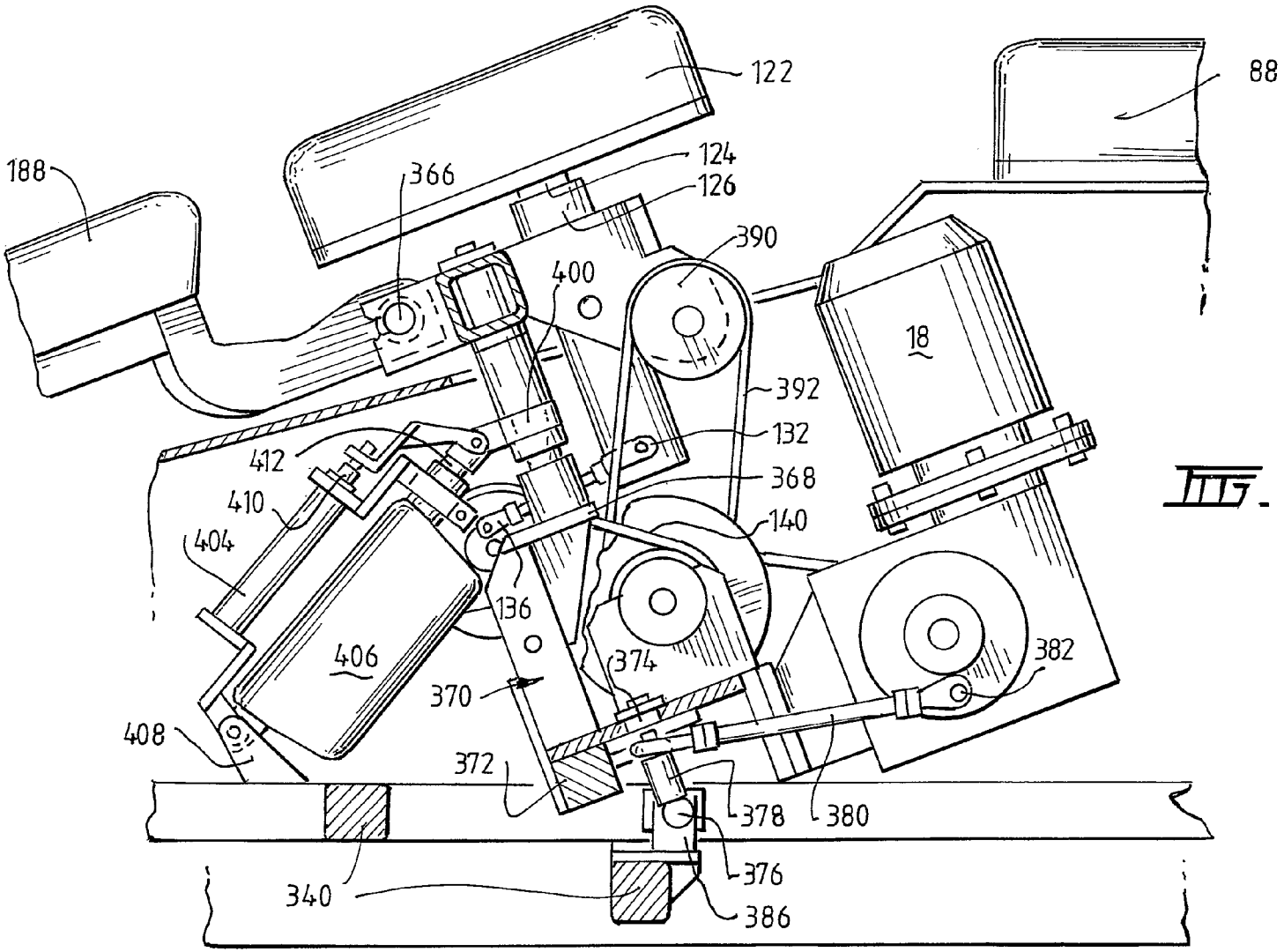
FIG. 11A is the same view as FIG. 11 showing movement of the exercise device.
Figure 12:
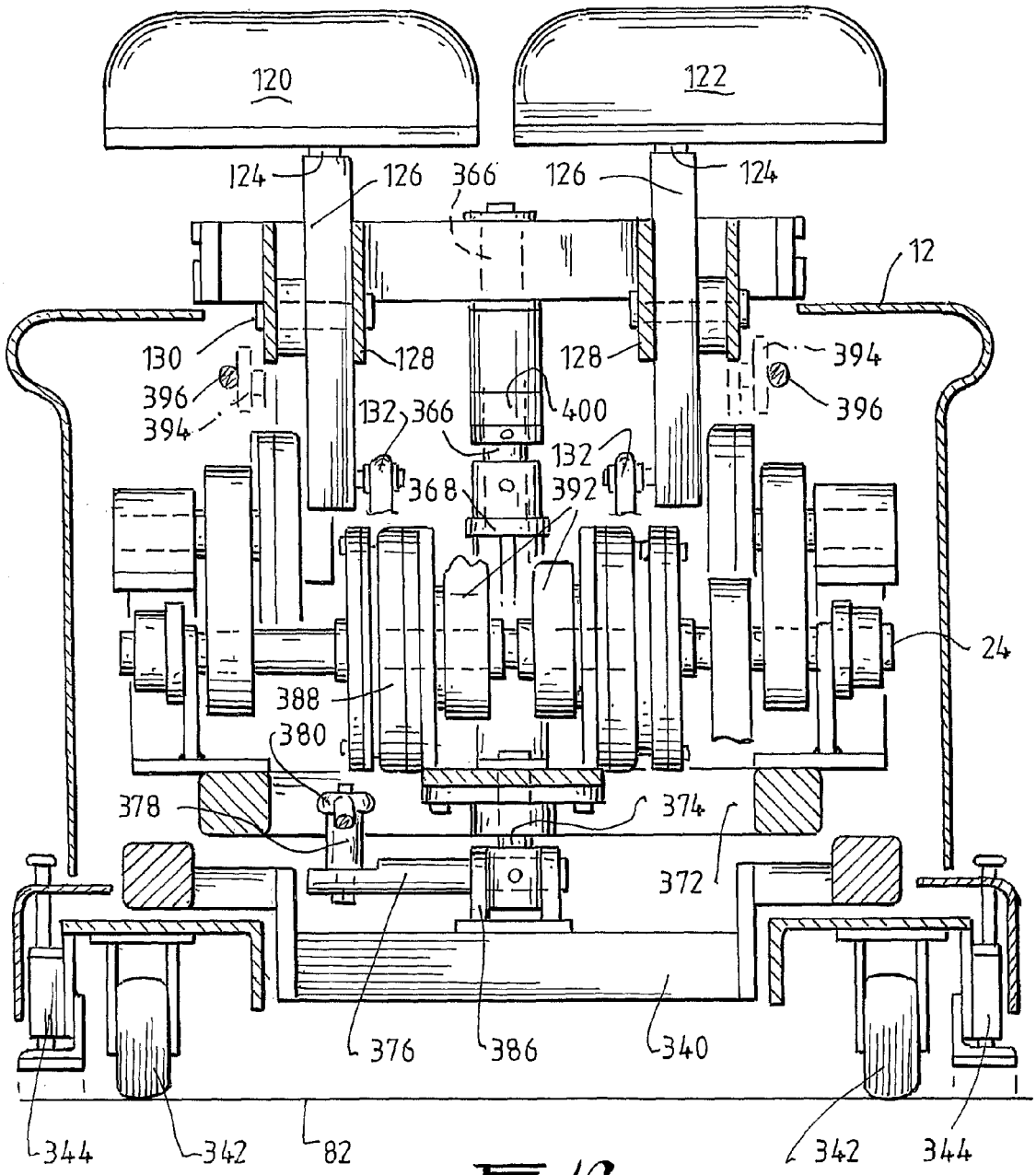
FIG. 12 is a cross-sectional view along and in the direction of arrows 12-12 of FIG. 11.
Figure 13:
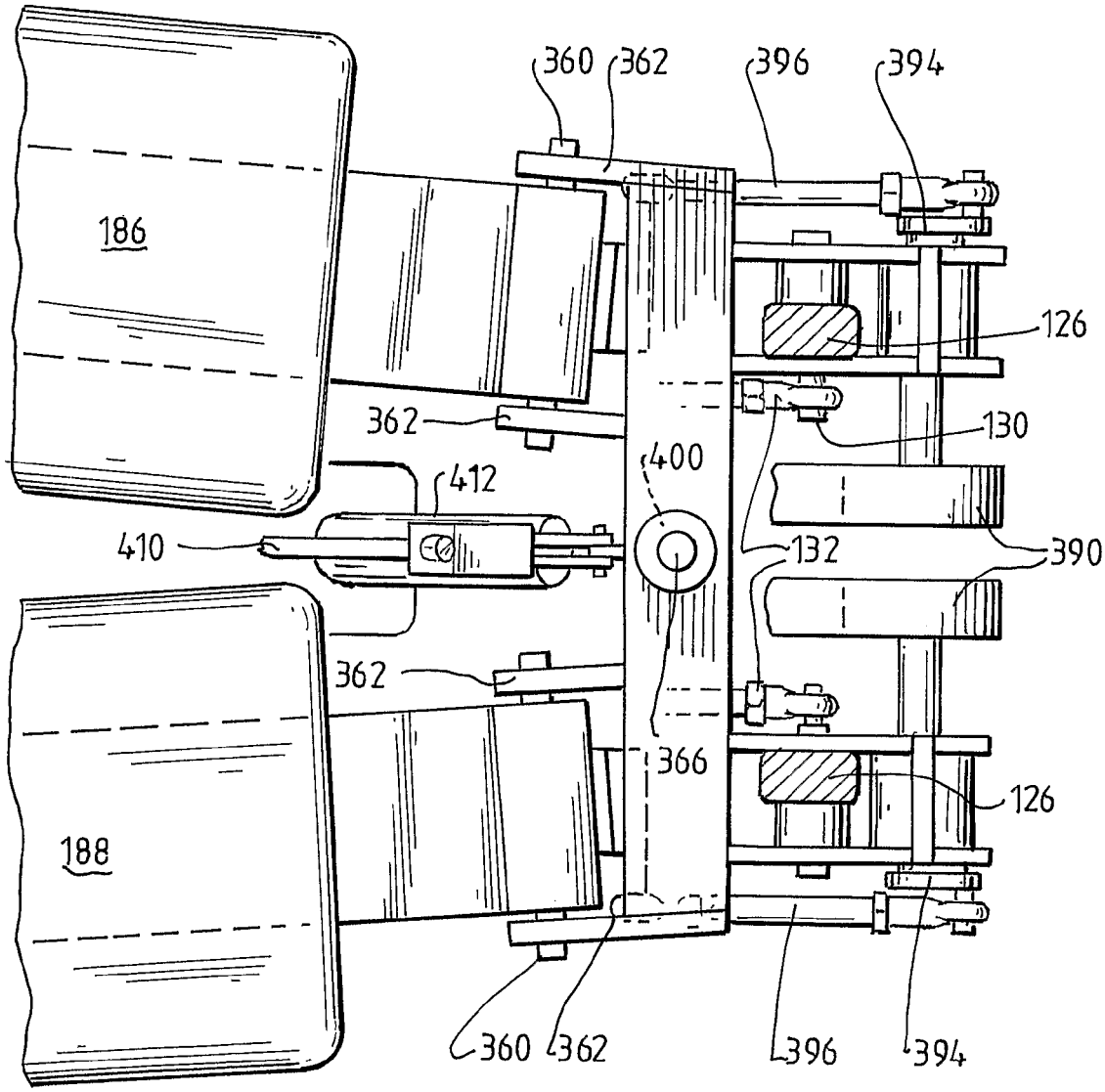
FIG. 13 is a cross-sectional view along and in the direction of arrows 13-13 of FIG. 11.
Figure 14:
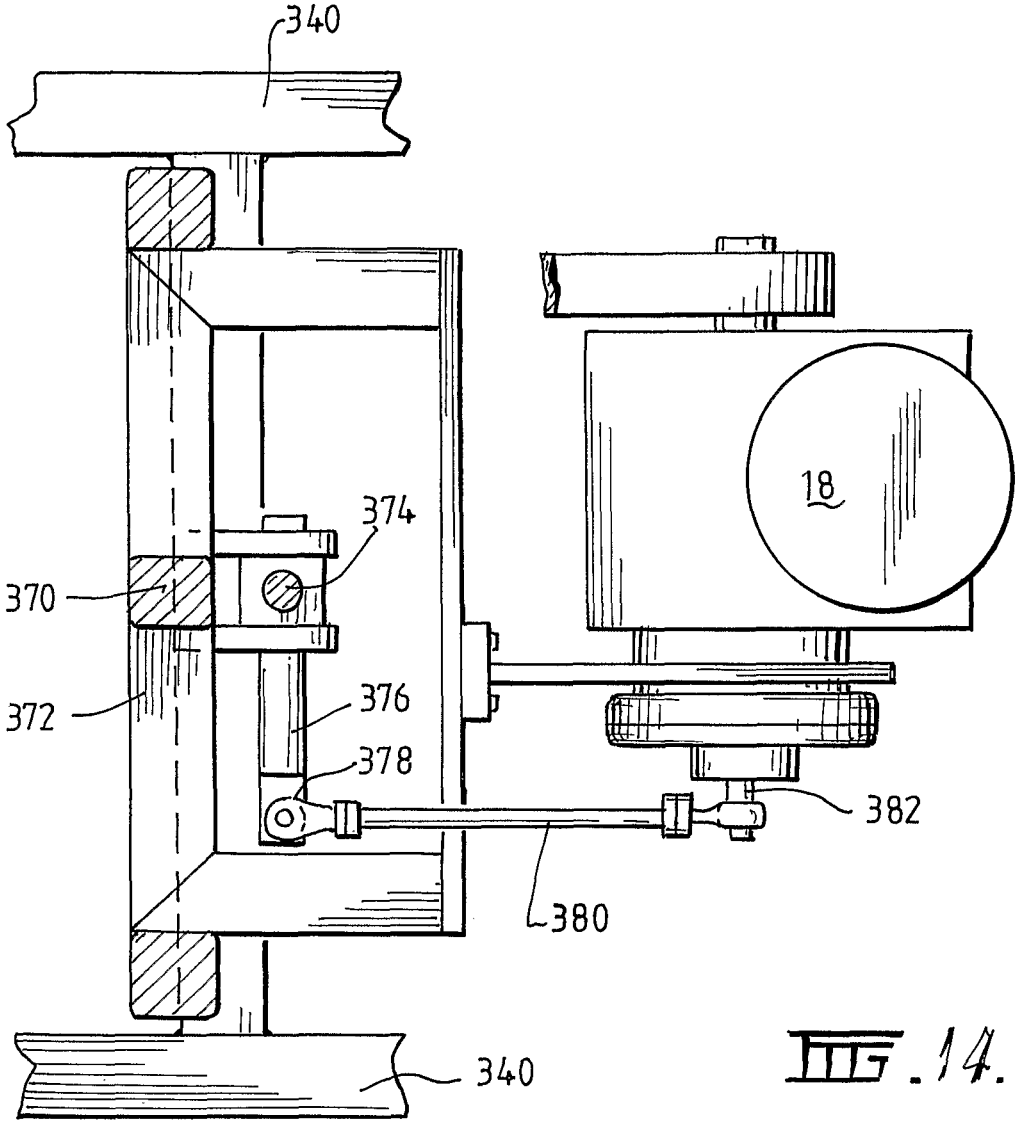
FIG. 14 is a cross-sectional view along and in the direction of arrows 14-14 of FIG. 11.

In FIGS. 11 and 12 the oscillating posterior seats 120, 122 of the first embodiment operate in a similar manner. The single oscillating seat 150 of the first embodiment has been substituted by having seats 120, 122 being able to oscillate in a horizontal manner. This improvement provides the advantage of seat 150 without having to remove seats 120, 122.

The exercise device shown in this embodiment allows exercise options not available on prior alt machines. If the rowing handles 32 are lowered to a horizontal position, and the leg supports 186, 188 are moved in a scissors action, a swimming type action can be simulated. Various movements are possible as follows:—

(a) scissors type movement of arms and legs with left leg up whilst right arm is down and right leg down whilst left arm is up—and then a reverse of these movements.

(b) dolphin type action with both legs moving up with both arms moving up and then both legs moving down as both arms move down.

(c) reverse dolphin action with both arms up as both legs are down and then both arms down as both legs are up.

For additional exercise strengthening, the leg supports 186, 188 and rowing handles 32 could be subject to variable resistance to provide a selection of reactive forces. Similarly, foot plates 302 could be subject to variable resistance and could move together or in a walking motion.

FIGS. 21 to 27 show a third embodiment of a part of the exercise device. The same reference numerals have been used for similar components to reduce repetition of description. In this embodiment, the raising and lowering of seats 120, 122 and leg supports 186, 188 shown in FIGS. 11 and 1 IA5 through pivoting about arm 376 has been removed. The scissor type action of leg supports 186, 188 is similar in action to that shown in FIGS. 11 to 20. Arm member 364 of the second embodiment is no longer connected to pin 366 and has simplified construction. Turntable frame 372 is coupled to pin 374 which rotates in bearing 500 secured to main frame 340. Turntable frame 370 includes an angled arm member 502, side support members 504 and rear member 506. As a link arm is attached at one end to a pivot 508 on main frame 380, turntable frame 372 will swivel from side to side with rotation of bell crank 382. As leg supports 186, 188 together with seats 120, 122 are attached to turntable frame 372 through angled arm member 502, leg supports 186, 188 and seats 120, 122 will be swivelled from side to side to provide a twisting exercise for the back.

The raising and lowering of leg supports 186, 188 uses the movement of drive arms 396 through rotation of bell cranks 394 as discussed with reference to the second embodiment. The angle of the range of movement of leg supports 186, 188 can be controlled by moving drive arms 396 towards or away from motor 18. This is best seen in FIGS. 24 to 27. A bifurcated arm member 510 has a fork 512 which supports drive half axles 514 which include bell cranks 394. The other end of each arm member 510 includes a pivotal plate 516 which is pivotally mounted to drive shaft 24.

Figures 25, 26:
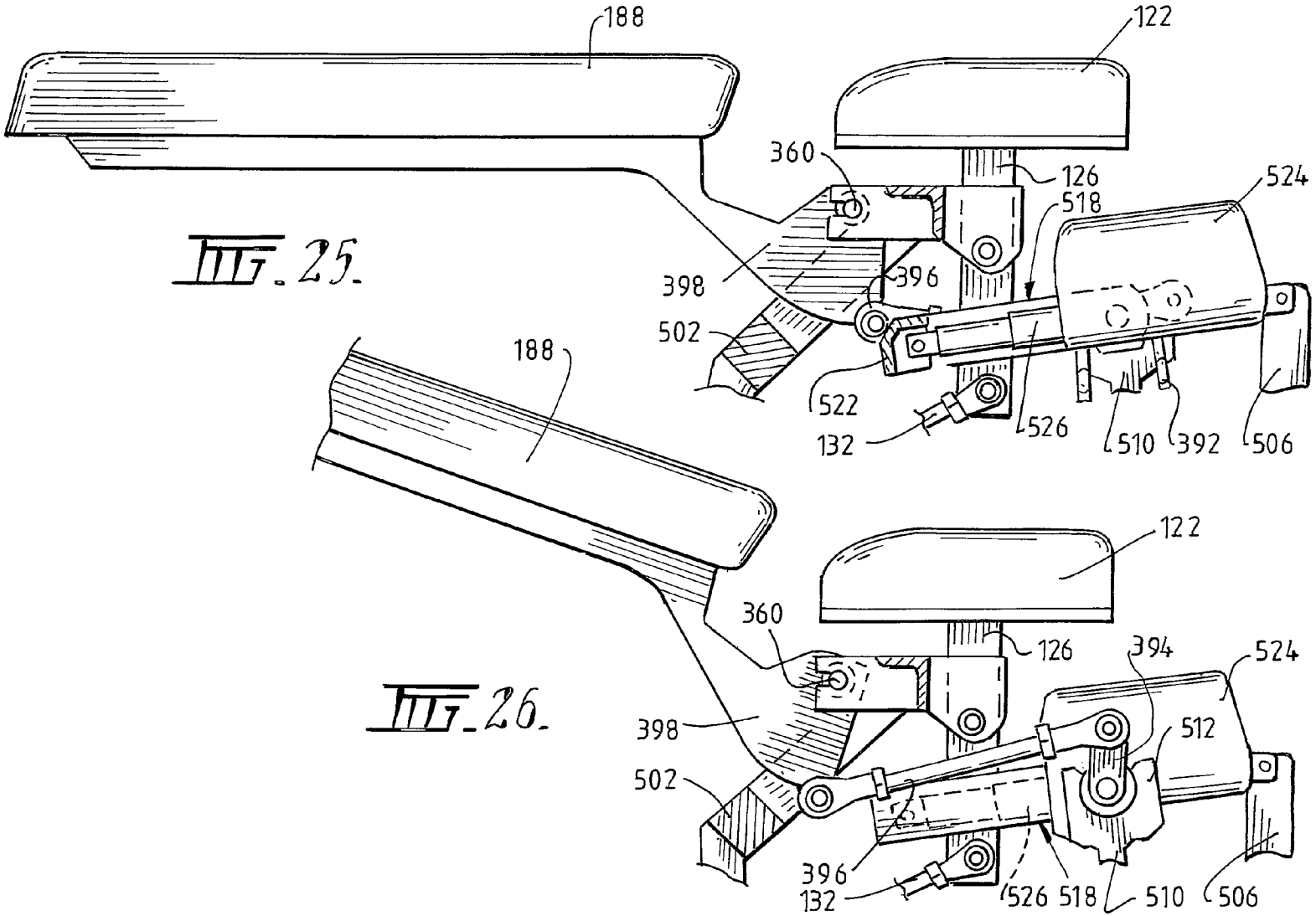
FIG. 25 is a cross-sectional view along and in the direction of arrows 25-25 of FIG. 22 with the leg supports in the horizontal position.
FIG. 26 is a similar view to that of FIG. 25 with the leg supports in a raised position.
Figure 27:
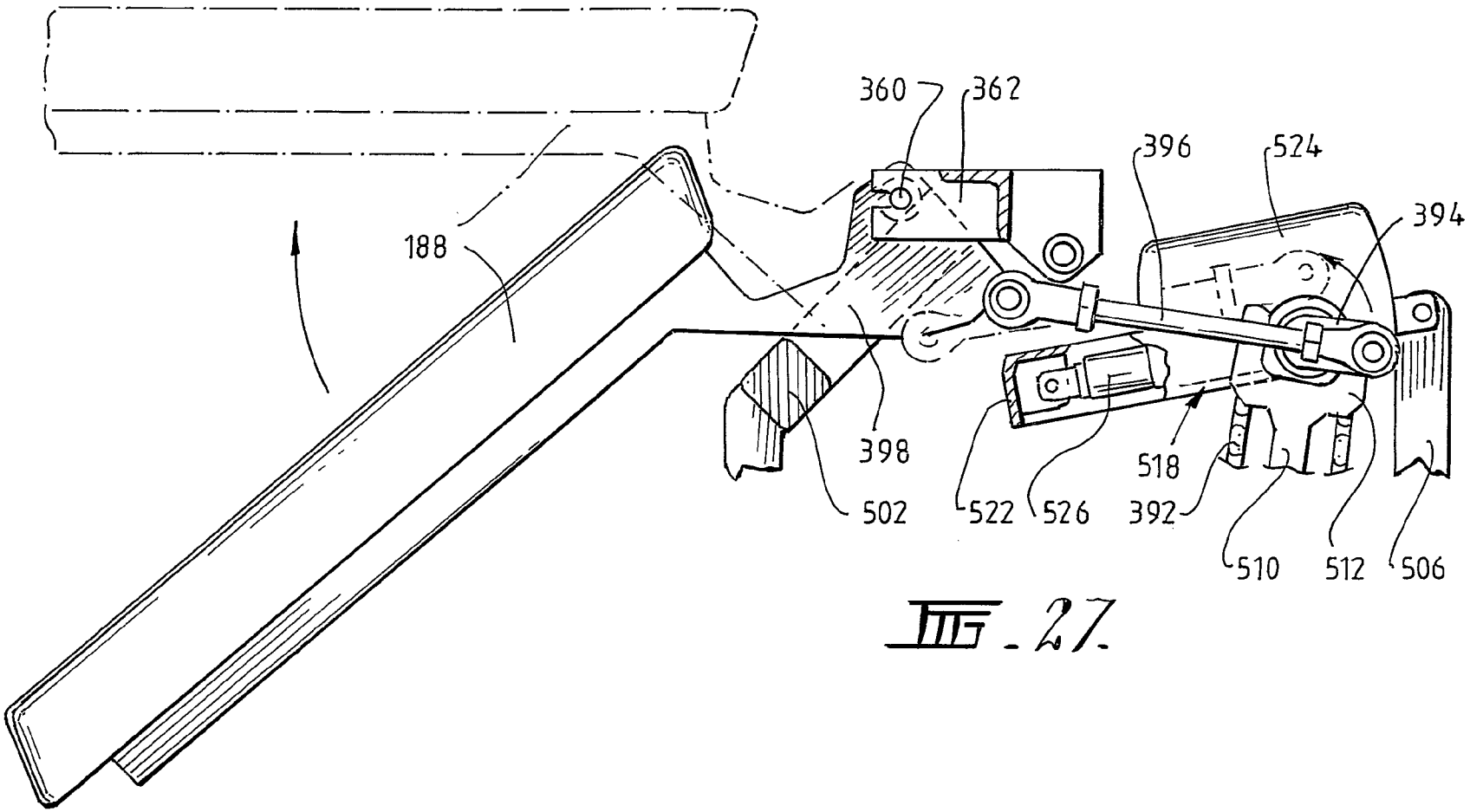
FIG. 27 is a similar view to that of FIG. 25 with the leg supports in a lowered position.

In order to hold bifurcated arm members 510 in position a U-shaped bracket 518 is used. Bracket 518 has main arms 520 and a cross arm 522. The free ends of main arms 520 are pivotally attached to half axles 514. A linear actuator 524 is pivotally attached to rear member 506 at one end and is pivotally attached to cross arm 522 at the other end. FIGS. 25 and 27 show the operation of the adjustment of the range of movement of leg supports 186, 188. FIG. 25 shows the neutral position where the leg supports 186, 188 are in the horizontal position. In FIG. 27 the ram 526 of linear actuator 524 has been retracted which will tilt bifurcated arm member 510 away from the position shown in FIG. 25. Accordingly, drive arms 396 will be forced upwardly which will lower leg supports 186, 188 because of the pivotal connections. Conversely, the extension of ram 526 will cause leg supports 186, 188 to be raised. Leg supports 186, 188 can thus be moved to a predetermined position. If required, the leg supports 186, 188 can then be moved up and down by movement of drive arms 396 through bell cranks 394.

The leg supports 186, 188 in this embodiment will allow the following features to be realised:—

(1) Move up to approximately 60 degrees from the horizontal and down again together.

(2) Move one leg up approximately 60 degrees whilst the other leg is lowering down to the horizontal or to approximately 15 degrees below horizontal.

(3) Move one leg up and down only whilst the other is stationary.

(4) Swivel from side to side approximately 25 degrees from the horizontal.

(5) Swivel to one side only approximately 25 degrees and then return to the horizontal.

(6) Lower from the horizontal in one degree increments to 25 degrees to enable functioning as a Flexion/Distraction table.

(7) Lowering of legs together to approximately 45 degrees and then returning to approximately 5 degrees above horizontal.

(8) Movement so that wherever the legs finish when an exercise program is completed the legs will always come back again to their horizontal starting position.

(9) Ability of the legs to move in combination with the rowing handles 32 with the two legs lowering as the rowing handles 32 move forward and vice versa or for the right leg to lower as the left rowing handle moves forward whilst the left leg lifts whilst the right rowing handle moves back and vice versa.

(10) Ability for one leg and one rowing handle only to move together whilst the other leg and rowing handle remain stationary.

(11) Ability of the legs to be controlled in their movement from one degree to any desired setting up to 100 degrees of their possible movement when moving up or when swivelling to the side.

Figure 28:
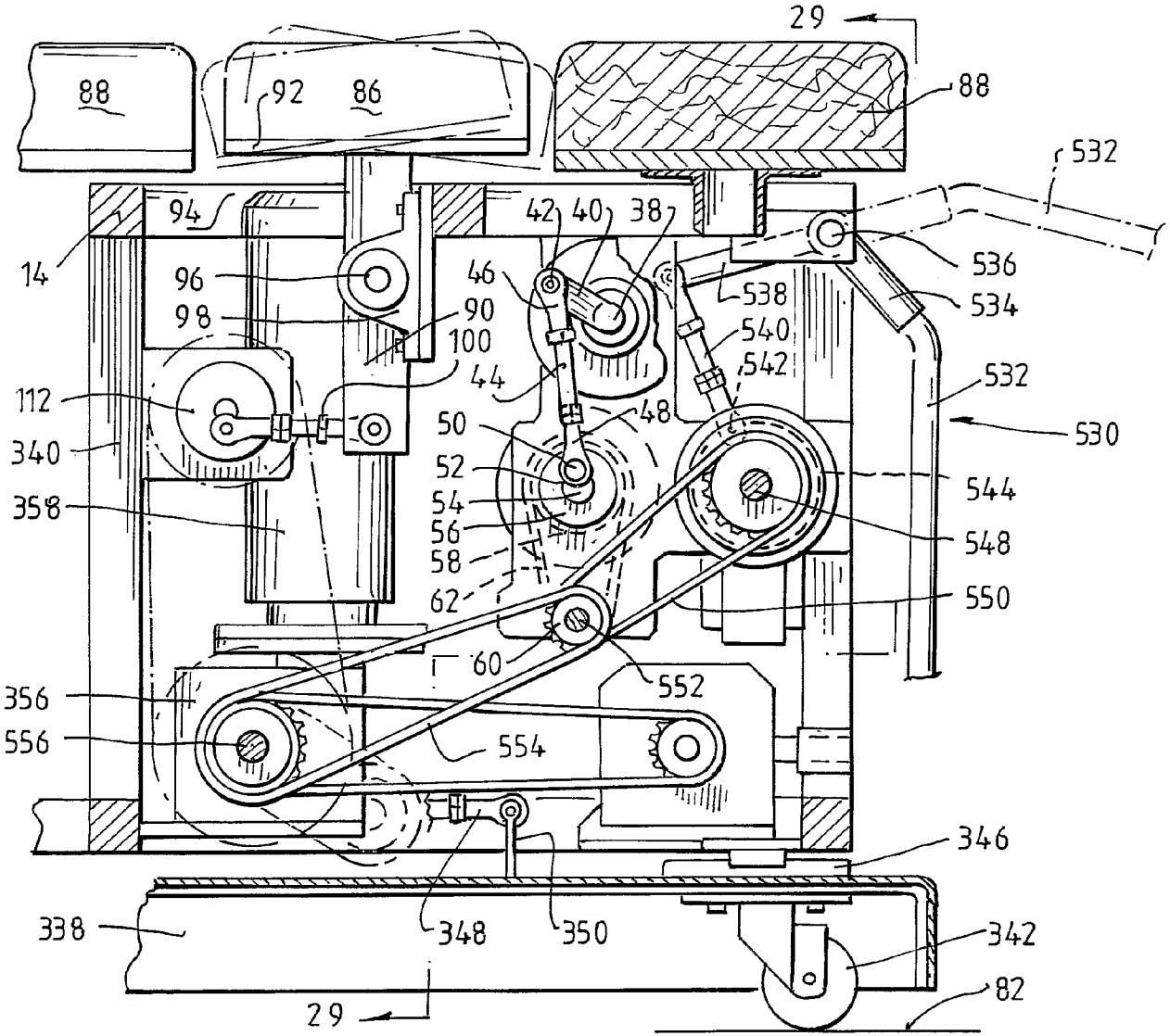
FIG. 28 is a similar view to that of FIG. 15 of a fourth embodiment of an exercise device made in accordance with the invention.
Figure 29:
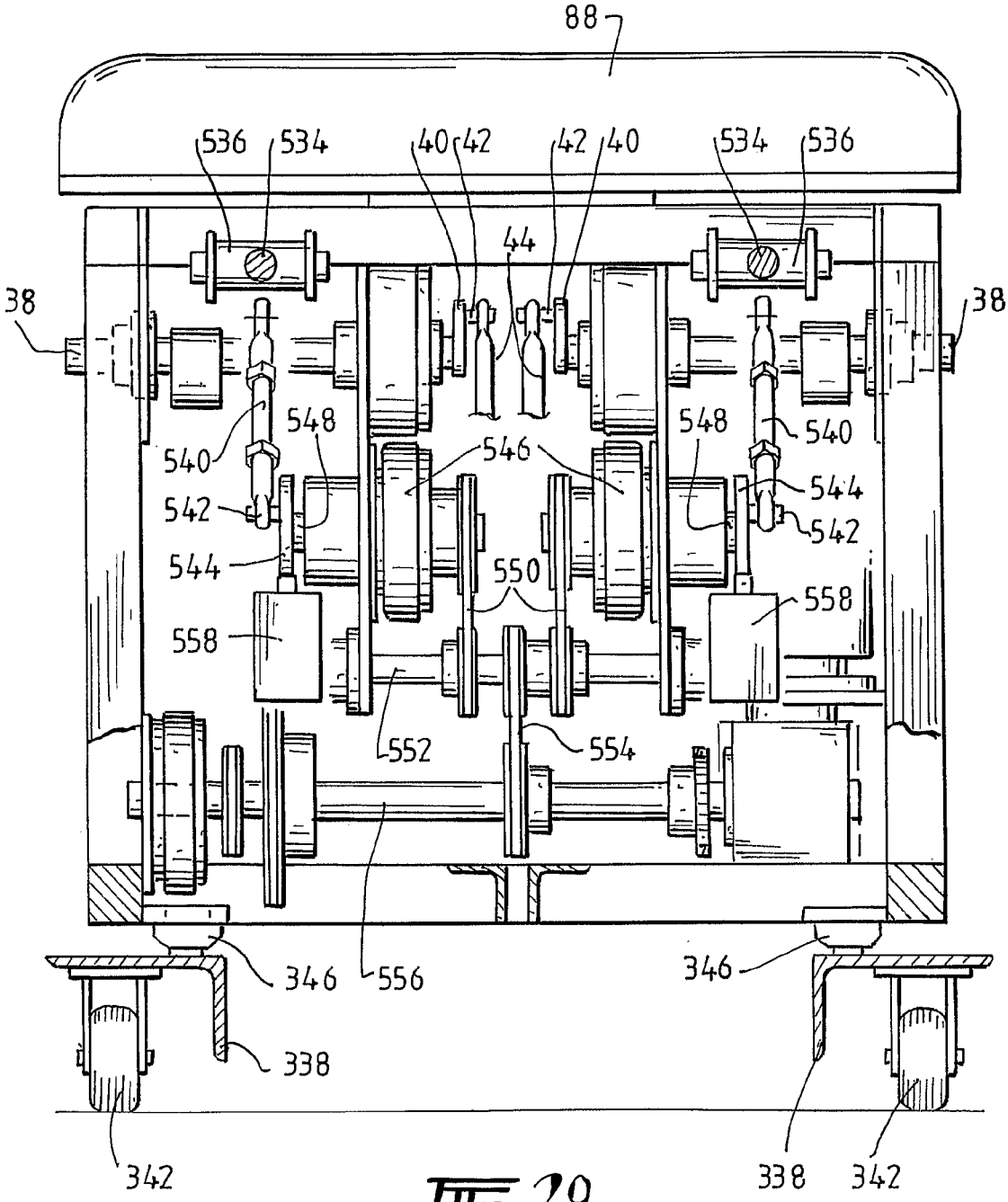
FIG. 29 is a cross-sectional view along and in the direction of arrows 29-29 of FIG. 28.

FIGS. 28 and 29 show a fourth embodiment of the exercise device, namely a knee curl device 530. The same reference numerals have been used for similar components to again reduce repetition of description. The knee curl device has a pair of leg members 532 which has an angled section 534 which is received in a rotatable journal 536. At the end of leg members 532 is provided a pair of foot plates (not shown) but similar to foot plates 302. A coupling lever 538 is located in journal 536 to provide a pivotal movement of leg member 532. A connecting rod 540 is pivotally linked to coupling lever 538 at one end and to offset pin 542 on rotatable disk 544 at the other end. A clutch 546 will provide rotation of disk 544 through shaft 548. Clutch 546 is driven by chain 550 from shaft 552. Shaft 552 is driven by chain 554 from shaft 556. In order to apply a resistance to movement of disk 544 a braking unit 558 is provided. The resistance can be controlled and clutch 546 will be disengaged, when required, so the user can press against leg members 532 rather than have the legs raised and lowered via drive shaft 552.

In use, in the lowered position the legs are bent. When the leg members 532 rise they lift up and out, thus lifting and straightening the leg. When the leg members 532 lower, the legs also lower and bend back to the rest position. This action therefore exercises the knee joint. The function can be performed as a dual leg exercise with both legs rising and lowering together or as a split leg function with one leg rising and straightening whilst the other lowers and bends. If an adjustable elbow joint (not shown) is provided at the bend of leg member 532, then by adjusting the elbow joint on the leg members 532 can be re-positioned to a near vertical position for a Hip Flexor Function. From this position the leg members 532 lift straight up and down with the legs in a bent position throughout, rather than out and up and then down and in the Knee Curl. The effects of the Hip Flexor Function with the legs being raised and lowered in a bent position will cause rotation at the hip thus exercising the hip joint. The Hip Flexor Function can also be undertaken as a dual leg or split bar function. Both the Knee Curl and Hip Flexor Functions can be undertaken as one leg only functions and both can be combined with a dual leg or split leg rowing function with one or two arms rowing. Each rowing handle 32 may be automatically locked into a vertical upright position when not in use. Similarly, each oscillating cushion 86, 120, 122 may be automatically locked into a horizontal position when not in use via a hydraulically operated solenoid (not shown) for each rowing handle and for each cushion.

Other variations to the construction and operation of the exercise device are envisaged. Front arm bars may be fitted or the existing rowing bars 32 may be adjusted in length and position to allow a scissor type arm movement in combination with the legs lifting up and down from a seated position. Side arm bars may be fitted or the existing rowing bars 32 may be adjusted in length and position at the head of the exercise device so that from a supine position the bars will move up and down in a rowing type action with graded resistance, either together or in opposite directions. These side arms could also slide up and down vertically from a prone position and also have graded resistance. The head end of the exercise device could be extended to allow for the addition of a height adjustable seat. From a safety aspect, safety bars can be fitted to one or both sides of the exercise device to prevent a user from rolling or falling off the exercise device. Any of the devices which include a clutch can be provided with a variable resistance component similar to braking unit 558. Braking unit 558 could also be replaced by hydraulic cylinders or other suitable devices.

Throughout this specification the use of sprockets and chains, and belts and pulleys has been described. It is clear to a man skilled in the art that the invention is not limited to these drive means as they could be replaced by any other suitable drive means.

The invention will be understood to embrace many further modifications as will be readily apparent to persons skilled in the alt and which will be deemed to reside within the broad scope and ambit of the invention, there having been set forth herein only the broad nature of the invention and a certain specific embodiment thereof by way of example.

The invention claimed is:

1. An exercise device which includes:

at least one pair of independently movable leg supports which are pivotally connectable to a main body support to raise and to lower in a raising plane and a lowering plane, either separately or together, a user's legs during exercise between an upper and a lower positions;

means for swinging said at least one pair of independently movable leg supports in a plane transverse to said raising and lowering planes of said leg supports;

an adjustment device comprising a rod and a piston, the adjustment device operating to tilt up or down an operating position of said at least one pair of leg supports, and wherein said adjustment device allows said leg supports to move between the upper and lower positions;

a knee extension device, said knee extension device including a pair of foot plates for reception of feet of the user, each of said foot plates attached to an end of a rod sliding within a bearing block, an opposite end of the rod mechanically coupled to an electric motor such that the foot plate reciprocates relative to the main body support when the rod slides within the bearing block; and a pair of rowing handles coupled to said electric motor, the handles pivoting to allow the user to undertake a rowing exercise from a seated position.

2. The exercise device of claim 1, further including a base frame which can be moved along a floor and is adapted to be clamped to said floor and a main frame which can be reciprocally moved relative to said base frame.

3. The exercise device of claim 1 wherein said means for swinging said at least one pair of independently movable leg supports in a plane transverse to the raising and lowering planes of said leg supports includes a turntable having said pair of leg supports attached thereto.

4. The exercise device of claim 1, further including one or more additional exercise components which can be selectively activated by a control means.

5. The exercise device of claim 4, wherein said additional exercise components include a rhythmic movement of said exercise device, an oscillating shoulder pad, a pair of oscillating posterior seats, vibrationary devices, and heating devices in various combinations.

6. The exercise device of claim 4, wherein said control means can control said one or more additional exercise components independently or in various combinations thereof.

7. The exercise device of claim 1, further including means for returning said movable leg supports to a starting position when exercise has been completed.

8. The exercise device of claim 1 wherein said adjustment device further comprises a hydraulic cylinder attached to said piston.

9. An exercise device which includes:

a main body support;

at least one pair of independently movable leg supports connected to the main body support and pivoting relative to the main body support to raise and to lower, either separately or together, a user's legs during exercise between upper and lower positions;

an adjustment device comprising a rod and a piston, the adjustment device allowing the movable leg supports to move between the upper and lower positions;

a knee extension device, said knee extension device including a pair of foot plates for reception of feet of the user, each of said foot plates attached to an end of a rod sliding within a bearing block, an opposite end of the rod mechanically coupled to an electric motor such that the foot plate reciprocates relative to the main body support when the rod slides within the bearing block; and a pair of pivotally movable rowing handles coupled to said electric motor, the handles pivoting to allow a user to undertake a rowing exercise from a seated position.

* * * * *